US011317777B1

(12) United States Patent
Robinson et al.

(10) Patent No.: US 11,317,777 B1
(45) Date of Patent: May 3, 2022

(54) METHOD OF CLEANING HARD SURFACE FLOORING WITH PORTABLE LIQUID-RECYCLING LIQUID-REUSING CLEANING SYSTEM

(71) Applicant: Kaivac, Inc., Hamilton, OH (US)

(72) Inventors: Robert S. Robinson, Hamilton, OH (US); Robert G. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 58 days.

(21) Appl. No.: 16/752,945

(22) Filed: Jan. 27, 2020

Related U.S. Application Data

(63) Continuation-in-part of application No. 15/065,832, filed on Mar. 10, 2016, now Pat. No. 10,959,592.

(60) Provisional application No. 62/797,265, filed on Jan. 26, 2019.

(51) Int. Cl.
*A47L 11/40* (2006.01)
*A47L 11/30* (2006.01)

(52) U.S. Cl.
CPC ..... *A47L 11/4022* (2013.01); *A47L 11/30* (2013.01); *A47L 11/4027* (2013.01); *A47L 11/4036* (2013.01); *A47L 11/4072* (2013.01); *A47L 11/4083* (2013.01)

(58) Field of Classification Search
None
See application file for complete search history.

(56) References Cited

U.S. PATENT DOCUMENTS

| | | | |
|---|---|---|---|
| 3,996,640 | A | 12/1976 | Blue et al. |
| 4,741,069 | A | 5/1988 | Helm et al. |
| 5,432,975 | A | 7/1995 | Hilmanowski |
| 5,768,742 | A | 6/1998 | Kohl et al. |

(Continued)

FOREIGN PATENT DOCUMENTS

| | | |
|---|---|---|
| EP | 2494899 | 9/2012 |
| WO | WO1994017721 | 8/1994 |
| WO | WO2013019823 | 2/2013 |

OTHER PUBLICATIONS

International Search Report (6 pages) for Int'l Appl'n No. PCT/IB2016/000843, Redelsperger, C. (Auth'd officer), dated Aug. 30, 2016 (mailing date), EPO (Int'l Searching Authority).

*Primary Examiner* — Rita P Adhlakha
(74) *Attorney, Agent, or Firm* — David E. Pritchard

(57) ABSTRACT

The method may include putting fresh cleaning liquid in the trolley bucket assembly bucket and the vacuum recovery tank; and, while propelling the system across hard surface flooring: dispensing fresh cleaning liquid from the bucket onto flooring by adjusting the spigot; spreading fresh cleaning liquid on flooring with the liquid spreader assembly; and vacuuming soil and cleaning liquid from flooring into the tank with the squeegee head assembly. The method may further include, when a desired amount of cleaning liquid has been dispensed from the bucket, or a desired amount of cleaning liquid has been vacuumed into the tank: stopping dispensing of cleaning liquid from the bucket; stopping propelling of the system; and transferring a desired amount of cleaning liquid from the tank to the bucket via the cleaning liquid transfer outlet. In addition, the method may include resuming propelling the system across flooring while also: dispensing; spreading; and vacuuming.

15 Claims, 16 Drawing Sheets

(56) References Cited

U.S. PATENT DOCUMENTS

| | | | | |
|---|---|---|---|---|
| 6,857,162 | B1 | 2/2005 | Rasmussen | |
| 6,997,395 | B2 | 2/2006 | Kawamoto | |
| 7,240,394 | B2 | 7/2007 | Kegg et al. | |
| 7,624,474 | B1 | 12/2009 | Cho | |
| 8,465,597 | B2 * | 6/2013 | Turner | A47L 7/0028 134/115 R |
| 2002/0116783 | A1 | 8/2002 | Giddings et al. | |
| 2005/0125935 | A1 | 6/2005 | Leonatti | |
| 2008/0295864 | A1 | 12/2008 | Turner | |
| 2009/0260177 | A1 | 10/2009 | Richards | |
| 2015/0040945 | A1 | 2/2015 | Venard et al. | |
| 2017/0095129 | A1 * | 4/2017 | Richter | A47L 11/4005 |

* cited by examiner

METHOD OF CLEANING HARD SURFACE FLOORING WITH PORTABLE LIQUID-RECYCLING LIQUID-REUSING CLEANING SYSTEM

CROSS-REFERENCE TO RELATED APPLICATIONS

This patent document is a continuation-in-part of U.S. Pat. No. 10,959,592, entitled "Portable Liquid-Recycling Liquid-Reusing Cleaning System for Hard Surface Flooring" and issued on Mar. 30, 2021. This patent document claims the benefit of the filing date of Provisional Application No. 62/797,265, entitled "Portable Liquid-Recycling Liquid-Reusing Cleaning System and Method for Cleaning Hard Surface Flooring" and filed on Jan. 26, 2019. The entire disclosure of each of (1) U.S. Pat. No. 10,959,592 and (2) Provisional Application No. 62/797,265 is incorporated into this patent document by reference.

FIELD OF THE INVENTION

This invention relates to methods of cleaning hard surface flooring using portable manually-propelled liquid-recycling liquid-reusing cleaning machines, in which the methods include recycling and reusing cleaning liquid.

BACKGROUND OF THE INVENTION

In areas of the United States and in other areas of the world, water is becoming less available, due in part to droughts, population increases, and the like. In fact, in some areas, water is either scarce or not available. In addition, in many areas, water consumption and water cost are increasing. Accordingly, organizations and individuals are looking for ways to conserve water and to reduce water consumption, including for example recycling and reusing water when possible and appropriate to do so.

One proposed aspect of water recycling and reuse involves the recycling and reuse of so-called "gray water." Gray water is a term used to describe the relatively clean waste water from sinks, showers, baths, dish washing machines, clothes washing machines, and the like—things that are found in many residential, commercial, industrial, and institutional buildings.

The process of cleaning, especially cleaning of commercial, industrial, and institutional buildings and other facilities, can consume a great deal of water. Accordingly, the use of gray water in cleaning has been proposed. This might include using gray water by itself or in combination with other cleaning chemicals. It also might include using gray water with various cleaning machines or other cleaning equipment. Another way to conserve water in the cleaning process is to recycle and reuse cleaning water—either potable water or gray water.

Although some ideas to address water conservation issues have been proposed, additional solutions are needed.

Also, the process of cleaning, especially cleaning of commercial, industrial, and institutional buildings and other facilities, can be very time-consuming and labor-intensive; and therefore, it can be quite expensive. Yet budgets for such cleaning are tight and are only getting tighter. Therefore, there is a huge demand for increased productivity—increased productivity of cleaning machines, and increased productivity of the cleaning professionals (i.e., users) using such machines. And every bit of productivity-increase matters greatly.

SUMMARY OF THE INVENTION

The invention solves these and other challenges by providing a method of cleaning hard surface flooring using a portable manually-propelled liquid-recycling liquid-reusing cleaning system.

If desired, the portable manually-propelled liquid-recycling liquid-reusing cleaning system may include a trolley bucket assembly, a vacuum recovery tank positioned on the trolley bucket assembly, and a vacuum motor assembly fluidly connected to the vacuum recovery tank.

In further detail, the trolley bucket assembly may include: a bucket operable to hold cleaning liquid; a wheeled chassis; and a manually-adjustable spigot fluidly connected to the bucket, the spigot including a valve that is adjustable throughout a range from a fully open position to a fully closed position, whereby when the bucket contains cleaning liquid, a user may dispense and regulate the flow of cleaning liquid from the bucket through the spigot by manually adjusting the spigot.

The vacuum recovery tank may be operable to hold cleaning liquid and soil. The vacuum recovery tank may include a bottom wall, a vacuum recovery inlet, and a cleaning liquid transfer outlet through which cleaning liquid from the vacuum recovery tank may be transferred to the bucket for reuse. The vacuum recovery tank bottom wall may include an interior surface; and the cleaning liquid transfer outlet may include a cleaning liquid entry opening through which cleaning liquid from the vacuum recovery tank may enter the cleaning liquid transfer outlet.

The cleaning liquid entry opening of the cleaning liquid transfer outlet may be positioned above at least a portion of the vacuum recovery tank bottom wall interior surface, thereby inhibiting soil that settles on the portion of the vacuum recovery tank bottom wall interior surface from passing through the vacuum recovery tank cleaning liquid transfer outlet.

If desired, the cleaning system also may include: a liquid spreader assembly operable to spread on hard surface flooring cleaning liquid that is dispensed from the bucket through the spigot; and a squeegee head assembly fluidly connected to the vacuum recovery inlet, the squeegee head assembly operable to vacuum soil and dispensed cleaning liquid from hard surface flooring into the vacuum recovery tank.

And if desired, the cleaning system may further include a component, an assembly, or the like that facilitates regulating the flow of cleaning liquid from the vacuum recovery tank to the bucket.

In one aspect, the method of cleaning hard surface flooring using a portable manually-propelled liquid-recycling liquid-reusing cleaning system may include putting fresh cleaning liquid in the bucket and putting fresh cleaning liquid in the vacuum recovery tank (e.g., filling at least a portion of each of the bucket and the vacuum recovery tank with fresh cleaning liquid).

The method also may include, while manually propelling the cleaning system across hard surface flooring: dispensing fresh cleaning liquid from the bucket onto hard surface flooring by manually adjusting the spigot; spreading dispensed fresh cleaning liquid on hard surface flooring with the liquid spreader assembly; and vacuuming soil and dispensed-and-spread cleaning liquid from hard surface flooring into the vacuum recovery tank with the squeegee head assembly.

The method may further include, when a desired amount of cleaning liquid has been dispensed from the bucket, or a desired amount of dispensed-and-spread cleaning liquid has been vacuumed into the vacuum recovery tank: stopping the dispensing of cleaning liquid from the bucket; stopping the manual propelling of the cleaning system; and transferring a desired amount of cleaning liquid from the vacuum recovery tank to the bucket via the cleaning liquid transfer outlet.

Also, the method may include resuming manually propelling the cleaning system across hard surface flooring while also: dispensing cleaning liquid from the bucket onto hard surface flooring by manually adjusting the spigot; spreading dispensed cleaning liquid on hard surface flooring with the liquid spreader assembly; and vacuuming soil and dispensed-and-spread cleaning liquid from hard surface flooring into the vacuum recovery tank with the squeegee head assembly.

In addition, after putting fresh cleaning liquid into each of the bucket and the vacuum recovery tank just one time, the cleaning method may include repeating some of the other steps over and over—recovering, recycling, and reusing the cleaning liquid to clean additional hard surface flooring—until the cleaning liquid is no longer suitable for reuse (e.g., when the cleaning liquid becomes heavily soiled), or until a desired amount of additional hard surface flooring has been cleaned if sooner.

In another aspect, the method of cleaning hard surface flooring using a portable manually-propelled liquid-recycling liquid-reusing cleaning system also may include putting fresh cleaning liquid in the bucket and putting fresh cleaning liquid in the vacuum recovery tank (e.g., filling at least a portion of each of the bucket and the vacuum recovery tank with fresh cleaning liquid).

In this other aspect, the method may further include: dispensing fresh cleaning liquid from the bucket onto a first area of hard surface flooring via the spigot by manually adjusting the spigot; vacuuming soil and dispensed cleaning liquid from the first area of hard surface flooring into the vacuum recovery tank; transferring a desired amount of cleaning liquid from the vacuum recovery tank to the bucket via the cleaning liquid transfer outlet; dispensing cleaning liquid from the bucket onto a second area of hard surface flooring via the spigot by manually adjusting the spigot; and vacuuming soil and dispensed cleaning liquid from the second area of hard surface flooring into the vacuum recovery tank.

In addition, in this other aspect of the method, after putting fresh cleaning liquid into each of the bucket and the vacuum recovery tank just one time, the cleaning method may include repeating some of the other steps over and over recovering, recycling, and reusing the cleaning liquid to clean other areas of hard surface flooring—until the cleaning liquid is no longer suitable for reuse (e.g., when the cleaning liquid becomes heavily soiled), or until the other areas of hard surface flooring have been cleaned if sooner.

The method of cleaning hard surface flooring provides several benefits and advantages. For example, because the method includes putting fresh cleaning liquid in both the bucket and the vacuum recovery tank, the method lakes it possible to clean a far greater amount of hard surface flooring before the recovered and reused cleaning liquid becomes unsuitable for further reuse, and therefore, before a user must suspend the cleaning process, return the cleaning system to a typically remote dumping-and-filling station, drain cleaning liquid and soil from the bucket and the vacuum recovery tank, rinse out the bucket and the vacuum recovery tank with clean water, re-fill the bucket and the vacuum recovery tank with fresh cleaning liquid, return the cleaning system to the hard surface flooring, and continue the cleaning process. And because the method greatly increases the amount of flooring that can be cleaned between dumping and refilling, the method greatly increases the productivity of the cleaning system and of a user operating the cleaning system (e.g., the number of square feet of flooring cleaned per hour).

Also, because the method includes putting fresh cleaning liquid in both the bucket and the vacuum recovery tank, the head pressure on the cleaning liquid in each of the trolley bucket and the vacuum recovery tank is increased. The increased head pressure facilitates a faster transfer of cleaning liquid from the vacuum recovery tank to the bucket, and a faster dispensing of cleaning liquid from the bucket to the hard surface flooring. Accordingly, the method further increases the productivity of the cleaning system and of a user operating the cleaning system (e.g., the number of square feet of flooring cleaned per hour).

BRIEF DESCRIPTION OF THE DRAWINGS

The accompanying drawings, which are incorporated into this patent document and constitute a part of this specification, illustrate embodiments of the invention and, together with the general description of the invention given above, and the detailed description of the drawings given below, serve to explain the principles of the invention.

DETAILED DESCRIPTION OF THE DRAWINGS

Figure 1:
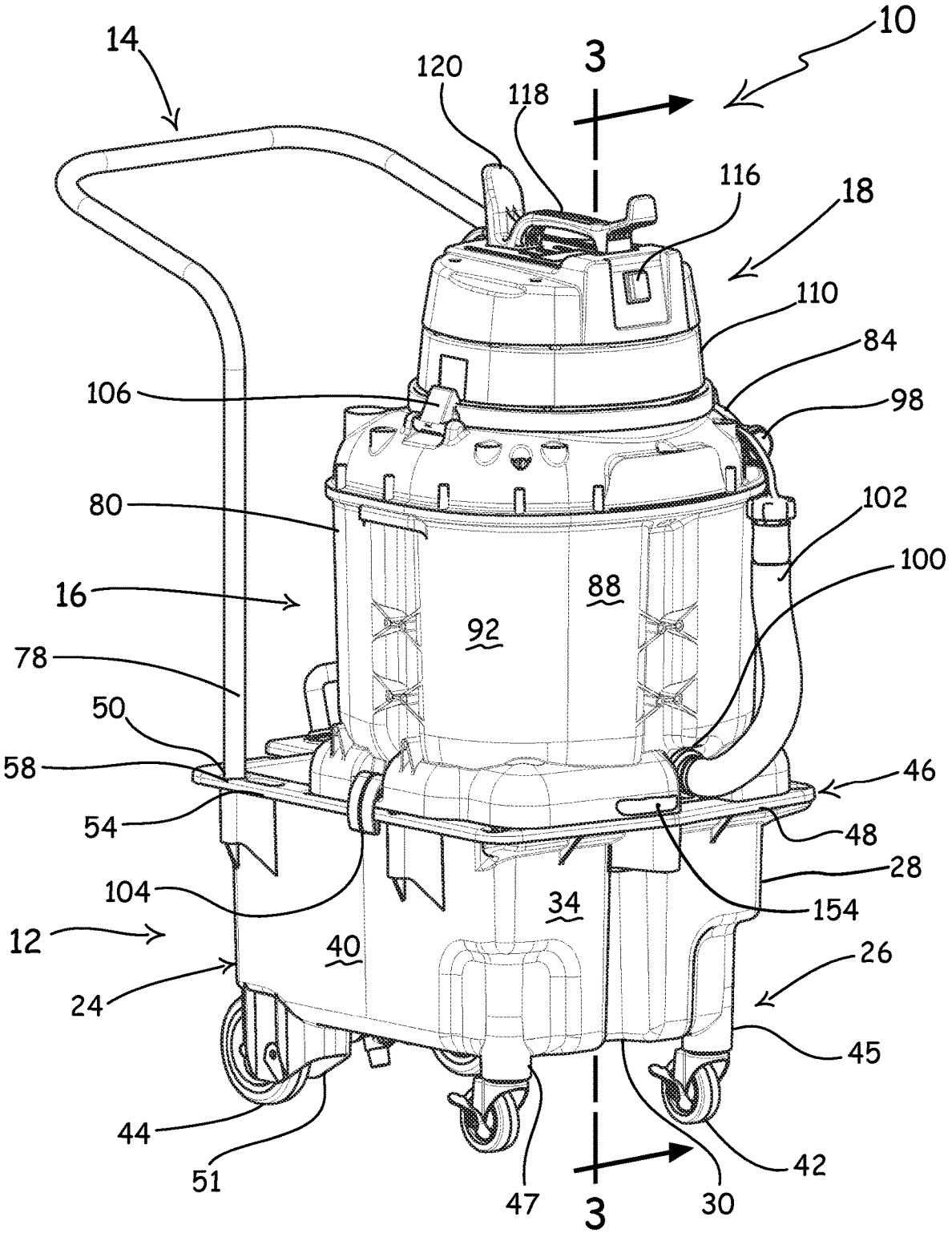
FIG. 1 is a perspective view of an embodiment of the portable liquid-recycling liquid-reusing cleaning system for hard surface flooring, in accordance with the principles of the invention.
Figure 2:
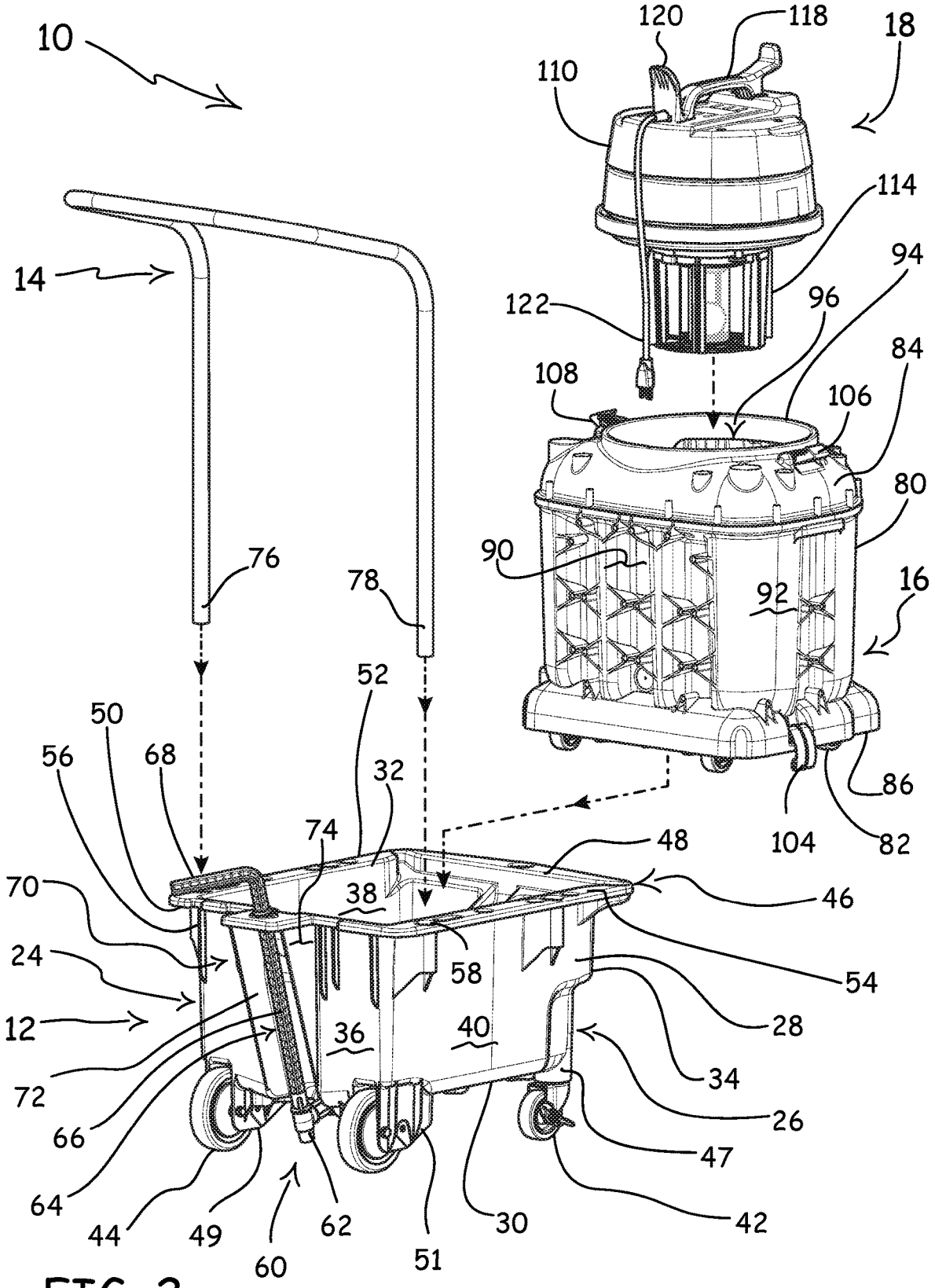
FIG. 2 is an exploded view of the portable liquid-recycling liquid-reusing cleaning system of FIG. 1.

In this detailed description of the drawings, in many instances, like reference numbers are used for like elements across multiple embodiments of the invention.

As used in this patent document, the term "liquid" is not limited to pure liquids unless stated otherwise. The term also includes, for example, solutions, mixtures, dispersions, suspensions, emulsions, and the like.

With reference to FIGS. 1-4, a particular embodiment 10 of the portable liquid-recycling liquid-reusing cleaning system for hard surface flooring, in accordance with the principles of the invention, is shown. The portable floor care system embodiment 10 has a trolley bucket assembly 12, a handle in the form of a four-bend handle 14, a vacuum recovery tank assembly 16, and a vacuum motor head assembly 18 fluidly connected to the vacuum recovery tank assembly.

The trolley bucket assembly 12 has a bucket 24 operable to hold cleaning liquid, a wheeled chassis 26, and a manually-adjustable spigot 62 fluidly connected to the bucket 24. The spigot has a valve that is adjustable throughout a range from a fully open position to a fully closed position, whereby when the bucket contains cleaning liquid, a user may dispense and regulate the flow of cleaning liquid from the bucket through the spigot by manually adjusting the spigot.

The vacuum recovery tank assembly 16 has a vacuum recovery tank 80 positioned on the trolley bucket assembly 12. The vacuum recovery tank is operable to hold cleaning liquid and soil. The vacuum recovery tank has a bottom wall 86, a vacuum recovery inlet 98, and a cleaning liquid transfer outlet that includes a standpipe 144 through which cleaning liquid from the vacuum recovery tank may be transferred to the bucket 24 for reuse. The bottom wall 86 has an interior surface 87. The cleaning liquid transfer outlet has a cleaning liquid entry opening that includes a gazebo nut 148 with multiple openings (as at 150) through which cleaning liquid from the vacuum recovery tank 80 enters the cleaning liquid transfer outlet.

The cleaning liquid entry opening of the cleaning liquid transfer outlet is positioned above at least a portion of the vacuum recovery tank bottom wall interior surface 87, thereby inhibiting soil that settles on the portion of the vacuum recovery tank bottom wall interior surface 87 from passing through the vacuum recovery tank cleaning liquid transfer outlet.

Figure 3:
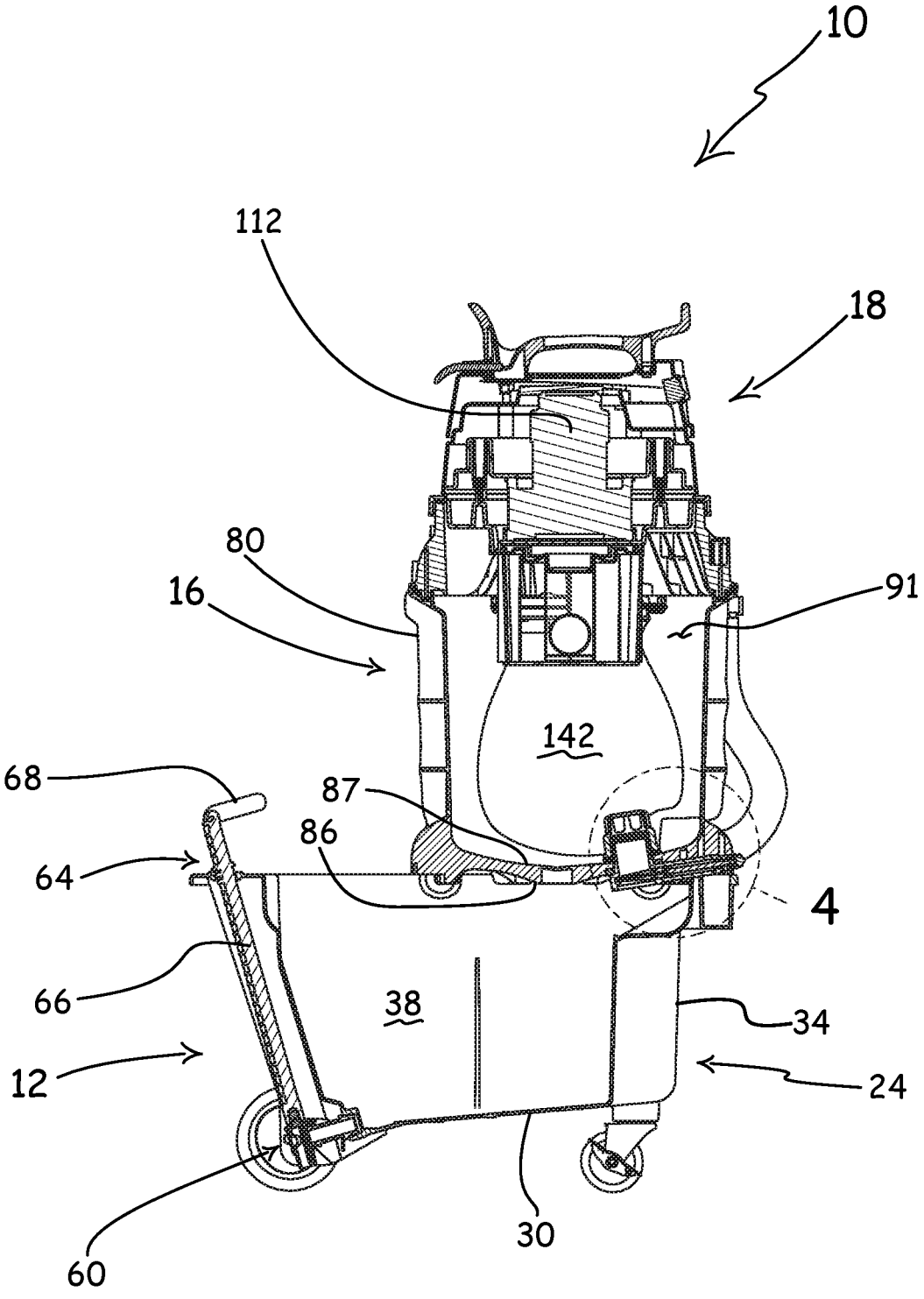
FIG. 3 is a cross-sectional view of the portable liquid-recycling liquid-reusing using cleaning system of FIG. 1, taken along line 3-3 of FIG. 1.
Figure 4:
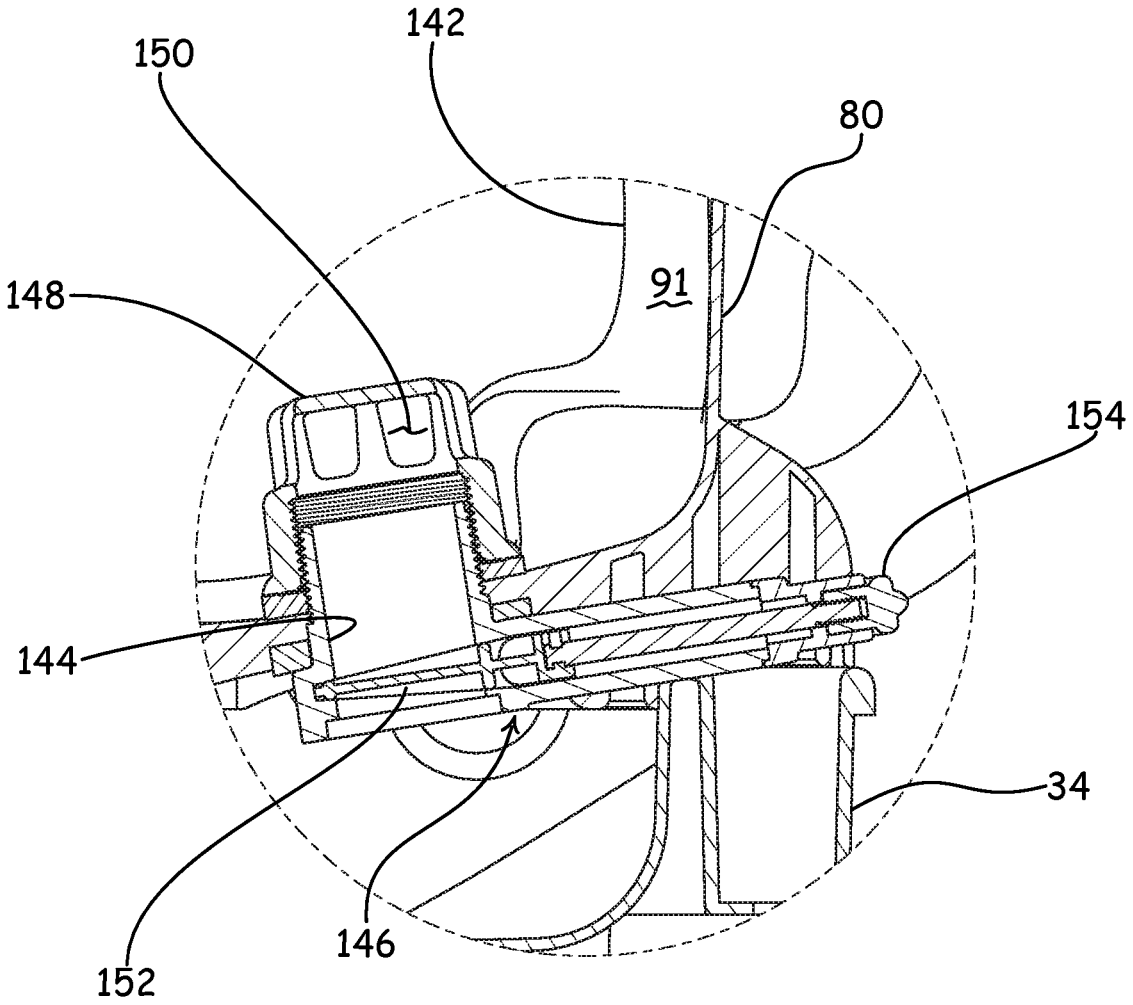
FIG. 4 is a portion of the cross-sectional view of FIG. 3, enlarged for magnification purposes.

With reference to FIGS. 3 and 4, the portable floor care system embodiment 10 also has a filter bag 142 and a gate valve assembly 146. The opening or mouth of the filter bag is positioned at the vacuum recovery inlet 98 (FIG. 1); and the filter bag is able to capture larger debris that may enter the vacuum recovery tank through the inlet 98. The gate valve assembly includes a slide gate 146 and a handle 154 for manually opening and closing the slide gate. The gate valve assembly enables a user to regulate the flow of cleaning liquid from the vacuum recovery tank to the bucket 24.

In this fashion, a user may dispense cleaning liquid from the bucket 24 through the spigot 62 onto hard surface flooring, may vacuum dispensed cleaning liquid and soil from hard surface flooring through the vacuum recovery inlet 98 into the vacuum recovery tank 80, may transfer recovered cleaning liquid from the vacuum recovery tank 80 through the cleaning liquid transfer outlet to the bucket 24 for reuse, and may dispense transferred cleaning liquid from the bucket 24 through the spigot 62 onto hard surface flooring.

The trolley bucket assembly 12 has a bucket 24 and a wheeled chassis 26 integral with the bucket. The bucket has a circumferential sidewall 28, a bottom wall 30, and an upper end 32—with the circumferential sidewall including a front wall 34, a back wall 36, a left sidewall 38, and a right sidewall 40. The bucket defines an interior space, and the bucket upper end defines an opening—with the bucket capable of holding a cleaning liquid (e.g., water or another cleaning liquid or solution). The wheeled chassis has four wheels—two swivel casters at the front (as at 42), and two fixed-axle wheels at the back (as at 44). At the front, the wheeled chassis includes a reinforced post or leg 45 at the front lower-left corner, and a reinforced post or leg 47 at the front lower-right corner. Each of these legs includes a cylindrical bore for receiving the post of the corresponding caster. At the back, the wheeled chassis includes a wheel frame 49 at the back lower-left corner, and a wheel frame 51 at the back lower-right corner.

The bucket 24 further has a top wall 46 at the bucket upper end 32. The top wall is integral with the circumferential sidewall 28, and extends outward away from the circumferential sidewall and bucket interior space. The top wall has a front section 48, a back section 50, a left section 52, and a right section 54—with each top wall section integral with an adjacent top wall section. The top wall left section has a cylindrical bore 56; and the top wall right section has a cylindrical bore 58. Each of the cylindrical bores has a bottom wall, with the bottom wall including an opening for drainage. One way in which the cylindrical bores 56, 58 may be used is discussed below, in connection with the four-bend handle 14.

The trolley bucket assembly 12 further has a spigot assembly 60 at the back of the bucket 24. The spigot assembly includes the manually-adjustable spigot 62 and a spigot handle 64 connected to the spigot. The spigot is fluidly connected to the bucket interior space; and the spigot has a valve that facilitates the spigot's ability to dispense and regulate the flow of a cleaning liquid from the reservoir through the spigot. The spigot handle is an elongated member in the form of an elongated rod that extends upward from the spigot. The spigot handle has an upwardly extending section 66 and a horizontal section 68 at the top of the upwardly extending section. A frame 70 extends rearward from the back wall 36 of the bucket; and the upwardly extending section of the spigot handle extends through an opening in the top wall of the frame. In further detail, the frame includes the top wall (a portion of the back section 50 of the top wall 46 of the bucket 24), a left sidewall 72, and a right sidewall 74. The left sidewall is positioned to the left of the spigot-handle upwardly extending section; and the right sidewall is positioned to the right of the spigot-handle upwardly extending section. The left and right sidewalls extend rearward from the bucket back wall and are integral with the bucket back wall and the frame top wall.

In use, a user typically operates the spigot handle 64 by grasping the horizontal section 68 and turning the section to the right or to the left. The spigot 62 is manually adjustable throughout a range from a fully open position to a fully closed position, whereby when the bucket 24 contains a cleaning liquid, a user may dispense and regulate the flow of the cleaning liquid from the bucket through the spigot by manually turning the spigot handle a desired amount to the right or to the left, thereby adjusting the spigot.

Various embodiments of the portable liquid-recycling liquid-reusing cleaning system, in accordance with the principles of the invention, may be configured: (1) so that at least a portion of the cleaning liquid dispensed from the bucket through the spigot flows directly from the spigot onto an area of hard surface flooring; (2) so that all of the cleaning liquid dispensed from the bucket through the spigot flows directly from the spigot onto an area of hard surface flooring; (3) so that at least a portion of the cleaning liquid dispensed from the bucket through the spigot flows indirectly from the spigot onto an area of hard surface flooring; and (4) so that all of the cleaning liquid dispensed from the bucket through the spigot flows indirectly from the spigot onto an area of hard surface flooring. One example of cleaning liquid flowing indirectly from the spigot onto an area of hard surface flooring involves a configuration in which cleaning liquid flows from the spigot to a liquid spreader device or assembly, and from the liquid spreader device or assembly to the hard surface flooring.

Additional aspects of the trolley bucket assembly are shown and described in: (1) U.S. Pat. No. 8,544,141, entitled "Cleaning Cart Systems" and issued on Oct. 1, 2013, (2) U.S. patent application Ser. No. 13/477,040, entitled "Modular Multi-Functional Cleaning and Floor Care System" and filed on May 21, 2012; and (3) U.S. Patent Application Publication No. US 2013/0125335, entitled "Modular Multi-Functional Cleaning and Floor Care System" and published on May 23, 2013. The entire disclosure of each of (1) U.S. Pat. No. 8,544,141, (2) U.S. patent application Ser. No. 13/477,040, and (3) U.S. Patent Application Publication No. US 2013/0125335 is incorporated into this patent document by reference.

Further aspects of the trolley bucket assembly are shown and described in: (1) U.S. Pat. No. 10,786,131, entitled "Multi-Functional Cleaning and Floor Care System" and issued on Sep. 29, 2020; and (2) U.S. Patent Application Publication No. US 2013/0139346, entitled "Multi-Functional Cleaning and Floor Care System" and published on Jun. 6, 2013. The entire disclosure of each of (1) U.S. Pat. No. 10,786,131 and (2) U.S. Patent Application Publication No. US 2013/0139346 is incorporated into this patent document by reference.

The vacuum recovery tank assembly 16 includes a vacuum recovery tank 80, four swivel caster wheels (as at 82) at the base of the tank, a dump hose 102 at the front of the tank, two fasteners in the form of hand-operable latches (as at 104) at the base of the tank, and two fasteners in the form of hand-operable latches 106, 108 at the top of the tank.

The vacuum recovery tank 80 has a top wall 84, a bottom wall 86, a front wall 88, a back wall 90, a left sidewall (not shown), and a right sidewall 92; and the tank defines an interior space operable to hold liquid and soil (e.g., soil-containing cleaning solution that has been vacuumed up from an area of hard surface flooring). The tank also has a vacuum recovery inlet 98 at a front left portion of the top wall 84, a cleaning liquid transfer outlet at an interior surface 87 of the bottom wall 86, and a dump outlet 100 at a lower portion of the front wall 88. The vacuum recovery inlet, the cleaning liquid transfer outlet, and the dump outlet are fluidly connected to the tank interior space. In addition, the tank-assembly dump hose 102 is fluidly connected to the dump outlet 100.

In this fashion, liquid and soil may be suctioned into the tank via the vacuum recovery inlet (e.g., via a length of vacuum hose connected to a floor tool or the like); and liquid and soil may be drained from the tank via the dump outlet and the dump hose (e.g., into a suitable receptacle, drain, or the like.) The top wall 84 has a circumferential rim 94 that defines a large opening 96. The opening provides a user with access to the tank interior space. The opening also enables the vacuum motor head assembly 18 (discussed in detail below) to be in fluid communication with the tank interior space when a user manually and removably positions (e.g., seats) the assembly 18 on the top wall 84 about the opening 96.

With regard to the fasteners, and as mentioned briefly above, two fasteners in the form of hand-operable latches (as at 104) are located at the base of the vacuum recovery tank 80. In further detail, one of the latches (as at 104) at the base of the tank is located at the tank right sidewall 92, and the other of the latches (not shown) at the base of the tank is located at the tank left sidewall (not shown). In use, a user may manually and removably position the tank on the bucket, and may do so without the use of a tool. With the tank on the bucket, a user may manually and releasably connect the tank to the bucket via the hand-operable latches (as at 104), and may do so without the use of a tool.

With further regard to the fasteners, and as mentioned briefly above, two fasteners in the form of hand-operable latches 106, 108 are located at the top of the vacuum recovery tank 80. In additional detail, latch 106 at the top of the tank is located at the tank top wall 84 to the right of the large opening 96, and latch 108 at the top of the tank is located at the tank top wall 84 to the left of the large opening 96. In use, a user may manually and removably position (e.g., seat) the vacuum motor head assembly 18 (discussed in detail below) on the top wall 84 about the opening 96. When the assembly 18 is positioned on the top wall 84 about the opening 96, a user may Manually and releasably connect the positioned assembly to the vacuum recovery tank via the hand-operable latches 106, 108, and may do so without the use of a tool.

The four bend handle 14 is manually and removably connected to the bucket 24. As noted above, the bucket has a top wall 46 at the bucket upper end 32. The top wall is integral with the bucket circumferential sidewall 28, extends outward away from the circumferential sidewall and bucket interior space, and has several sections. The top-wall left section 52 has a cylindrical bore 56, and the top-wall right section 54 has a cylindrical bore 58—with each of the cylindrical bores having a bottom wall. The four bend handle 14 has a left leg 76 and a right leg 78. In manually and removably connecting the four bend handle to the bucket, the left leg is positioned in the cylindrical bore 56, and the right leg is positioned in the cylindrical bore 58.

The vacuum motor head assembly 18 has an outer housing 110, a vacuum motor assembly 112 (FIG. 3), and an automatic shutoff system in the form of a float shutoff assembly 114. The outer housing has an on/off switch 116, a main handle 118, a steering tab or handle 120, and a power cord 122 for manual and removable connection to a suitable AC electrical cord—for example, an AC electrical cord connectable to a conventional wall outlet. In use, a user may grasp or otherwise exert force on the steering tab to facilitate moving (e.g., pushing or pulling) the portable floor care system 10. The vacuum motor assembly 112 may have any suitable specifications. For example, if desired, the vacuum motor assembly may have a vacuum lift of 80 inches of water and an air flow of 60 cubic feet per minute. Alternatively, if desired, the vacuum motor assembly may have a vacuum lift of 77 inches of water and an air flow of 62 cubic feet per minute.

If desired, a DC vacuum motor head assembly may be used—either in place of or interchangeably with the vacuum motor head assembly 18. A DC power supply assembly may be used to power such a DC vacuum motor head assembly. If desired, the DC motor of the DC vacuum motor assembly may be a 36 volt DC motor. Also, if desired, the DC vacuum motor assembly may have a vacuum lift of 80 inches of water and an air flow of 60 cubic feet per minute. Alternatively, if desired, the DC vacuum motor assembly may have a vacuum lift of 77 inches of water and an air flow of 62 cubic feet per minute.

If desired, the DC power supply assembly may have a rechargeable Lithium-ion battery positioned in a battery box. The Lithium-ion battery may have any suitable specifications. For example, if desired, the Lithium-ion battery may be a 36 volt DC battery with a 20 amp hour rating. The DC power supply assembly also may have a fastener in the form of a strap connected to an exterior surface of the battery box. If desired, the strap may have a male snap member and a corresponding female snap member. In use, a user may manually and removably position the DC power supply assembly on the bucket, and may do so without the use of a tool. With the DC power supply assembly on the bucket, a user may manually and releasably connect the DC power supply assembly to the bucket via a fastener assembly, and may do so without the use of a tool. If desired, the fastener assembly may include the strap and the leg 78 of the four bend handle 14. For example, with the handle manually and removably connected to the reservoir (as discussed above), a user may wrap a portion of the strap around the leg 78, and releasably secure the male and female snap members to one another.

An example of a system with interchangeable AC and DC vacuum motor head assemblies is shown and described in U.S. Pat. No. 9,854,955, entitled "Floor Care System with Interchangeable AC and DC Vacuum Motor Assemblies" and issued on Jan. 2, 2018. The entire disclosure of U.S. Pat. No. 9,854,955 is incorporated into this patent document by reference.

Figure 5:
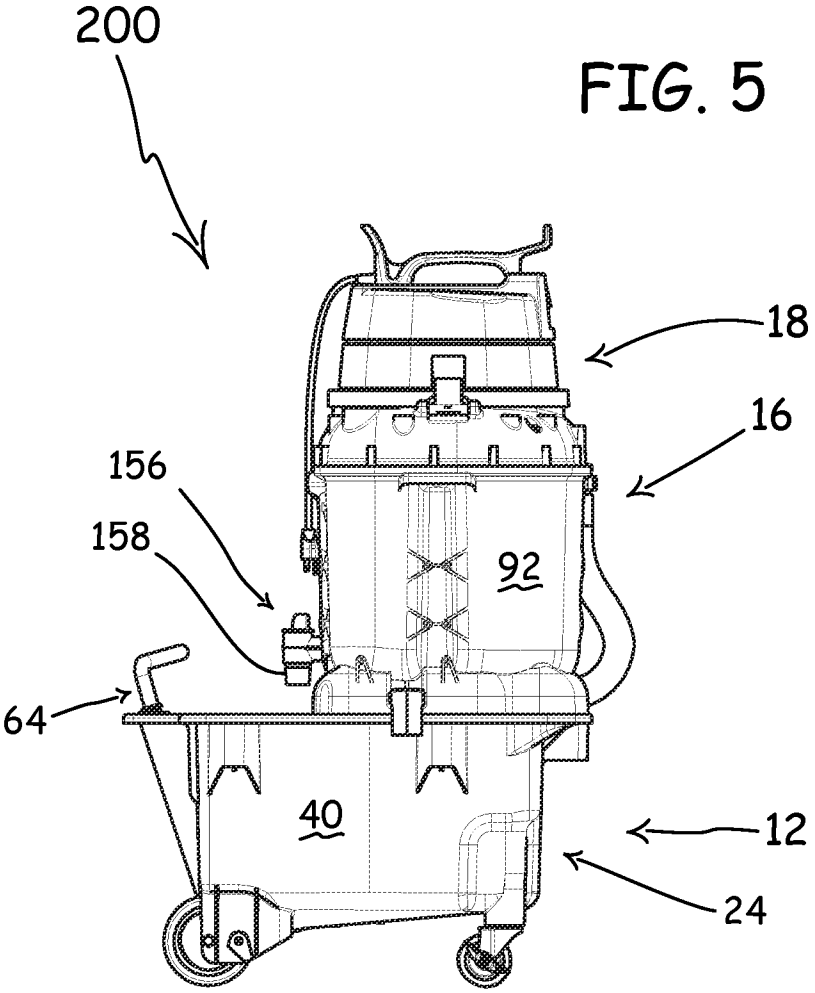
FIG. 5 is a right side view of another embodiment of the portable liquid-recycling liquid-reusing cleaning system for hard surface flooring, in accordance with the principles of the invention.
Figure 6:
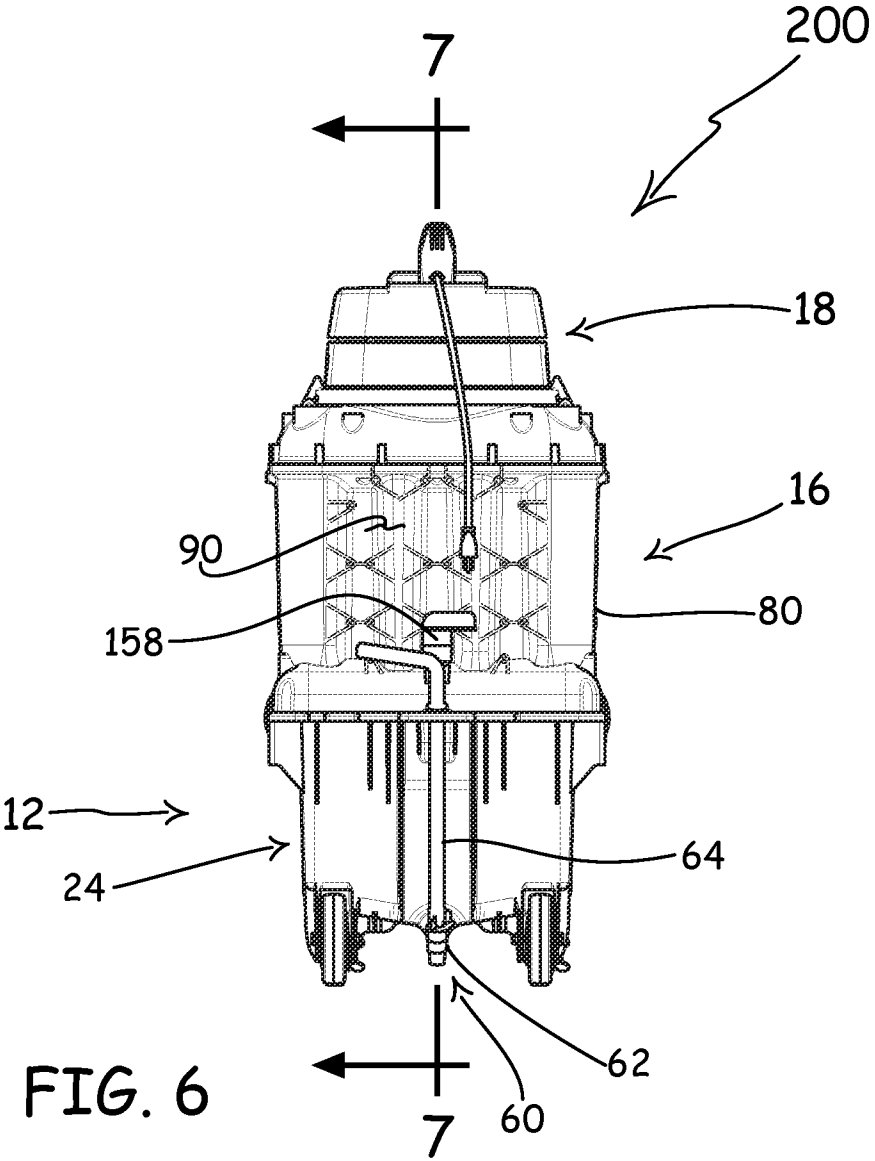
FIG. 6 is a back view of the portable liquid-recycling liquid-reusing cleaning system of FIG. 5.
Figure 7:
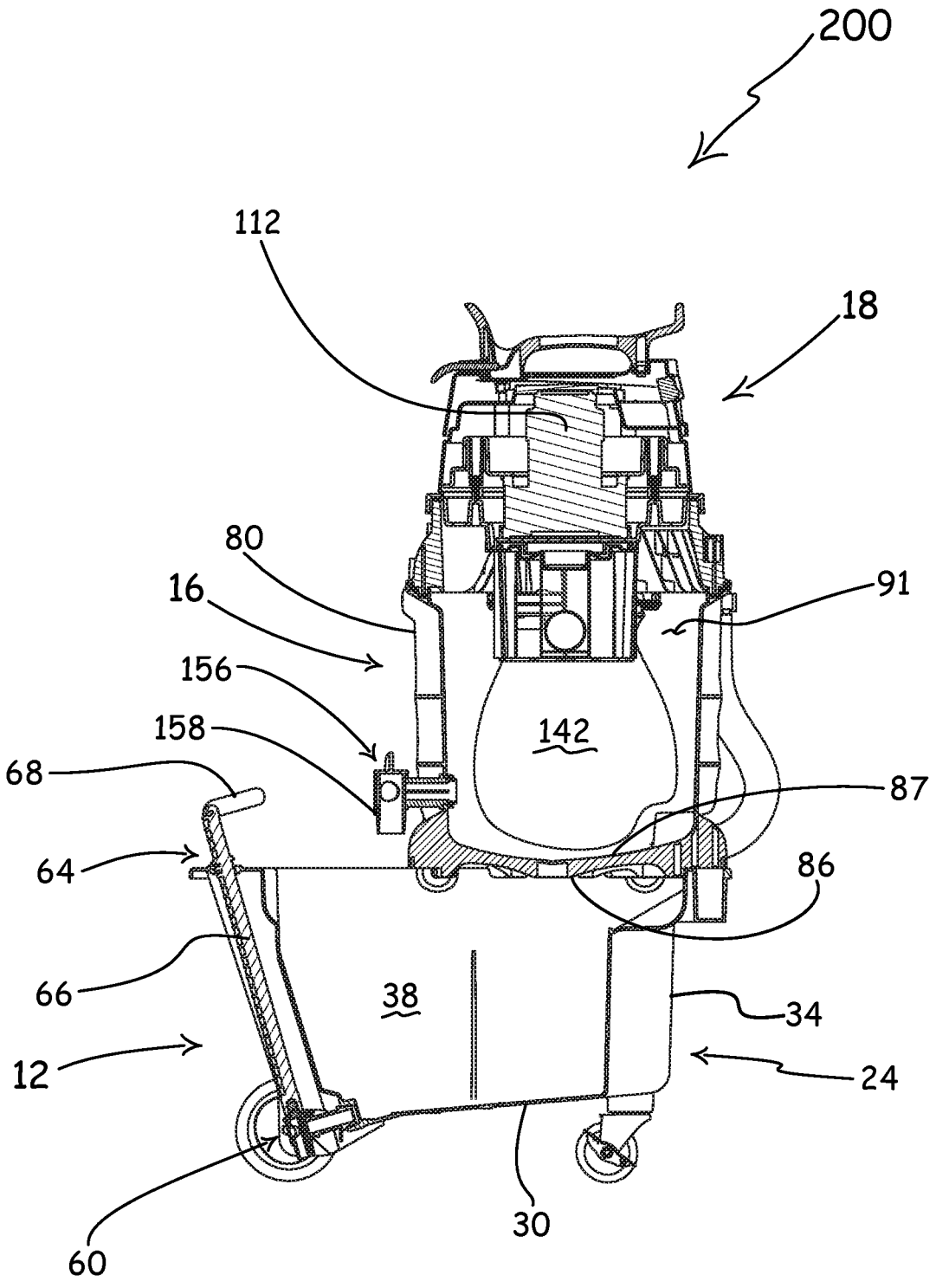
FIG. 7 is a cross-sectional view of the portable liquid-recycling liquid-reusing cleaning system of FIGS. 5 and 6, taken along line 7-7 of FIG. 6.

With reference to FIGS. 5-7, the portable floor care system embodiment 200 is identical to the embodiment 10 with the following exceptions. The embodiment 200 does not have the standpipe 144, the gazebo nut 148, or the gate valve assembly 146. Instead, the embodiment 200 has a vacuum recovery tank spigot assembly 156. The spigot assembly extends rearward from the back wall 90 of the vacuum recovery tank 80. The assembly 156 includes a generally vertically oriented manually-adjustable vacuum recovery tank spigot 158 and a generally horizontally extending tube that fluidly connects the spigot 158 to the interior of the tank 80. The cleaning liquid transfer outlet includes the generally horizontally extending tube; and the cleaning liquid entry opening includes the inlet end of the tube, with the inlet end positioned in the interior of the tank 80. The manually-adjustable vacuum recovery tank spigot 158 includes a valve that is adjustable throughout a range from a fully open position to a fully closed position (i.e., a range between and including a fully open position and a fully closed position), whereby when the vacuum recovery tank contains cleaning liquid, a user may dispense and regulate the flow of cleaning liquid from the vacuum recovery tank to the bucket through the vacuum recovery tank spigot by manually adjusting the spigot.

Figure 8:
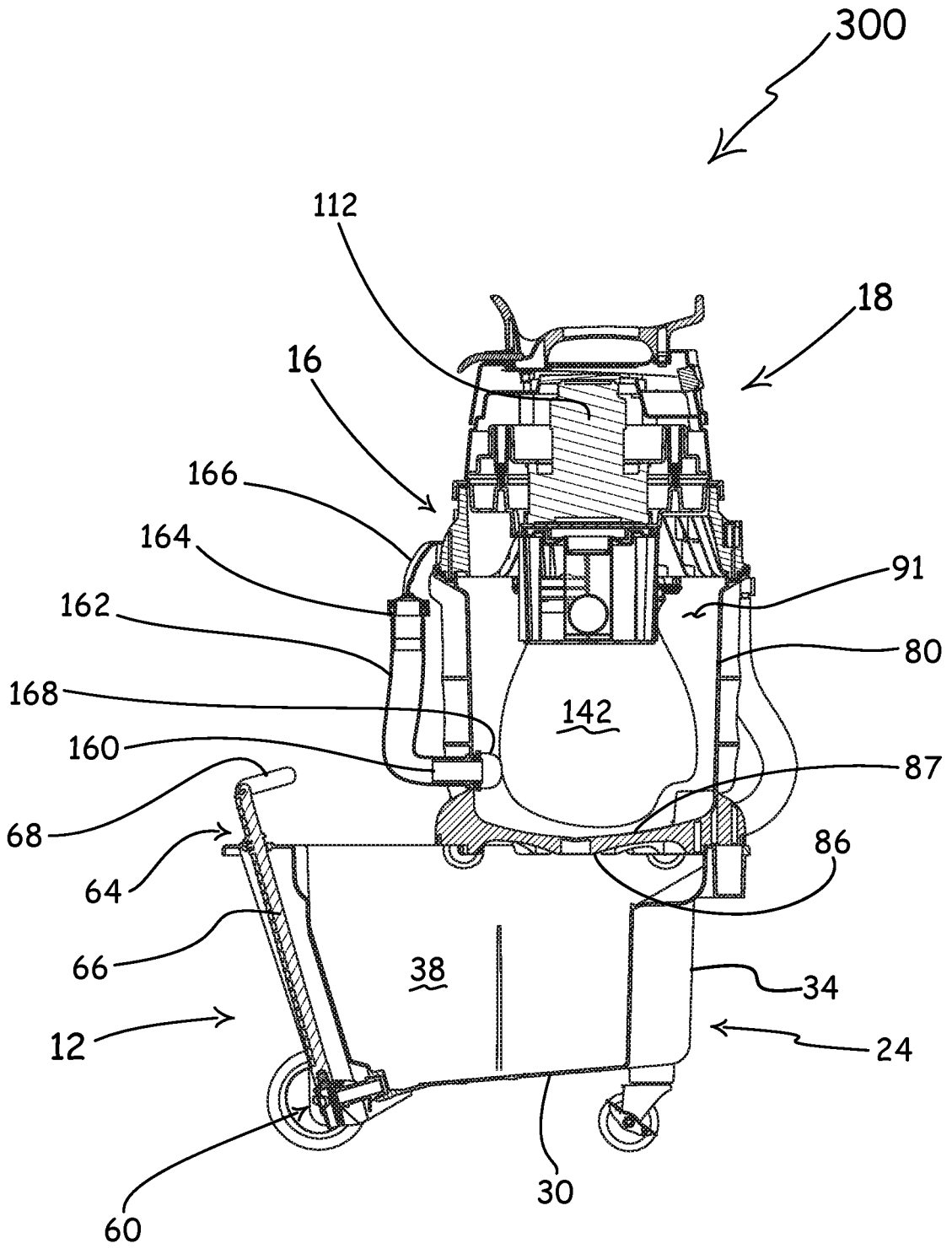
FIG. 8 is a cross-sectional view of an additional embodiment of the portable liquid-recycling liquid-reusing cleaning system for hard surface flooring, in accordance with the principles of the invention.

With reference to FIG. 8, the portable floor care system embodiment 300 is identical to the embodiment 10 with the following exceptions. The embodiment 300 does not have the standpipe 144, the gazebo nut 148, or the gate valve assembly 146. Instead, the embodiment 300 has a transfer-hose-and-cap assembly. A cleaning liquid transfer outlet includes a generally horizontally extending tube 160 that extends from the interior of the vacuum recovery tank 80 rearward through the back wall 90 of the tank 80. The cleaning liquid transfer outlet has a cleaning liquid entry opening that includes an inlet end of the tube 160. An inlet end of a cleaning liquid transfer hose 162 is connected to an outlet end of the tube 160, a cap 164 is connected to an outlet end of the cleaning liquid transfer hose 162, and a strap 166 connects the cap 164 to an upper exterior surface of the vacuum recovery tank 80. A mushroom filter 168 is attached to the inlet end of the tube 160. As seen in FIG. 8, the transfer hose 162 is in an upwardly-extending stowed position. When a user wants to transfer cleaning liquid from the tank 80 to the bucket 24, the user may remove the cap 164 from the hose 162 and orient the outlet end of the hose downward into the bucket 24. When a user wants to stop the transfer of cleaning liquid from the tank 80 to the bucket 24, the user may raise the hose upward and close the outlet end of the hose with the cap 164.

Figure 9:
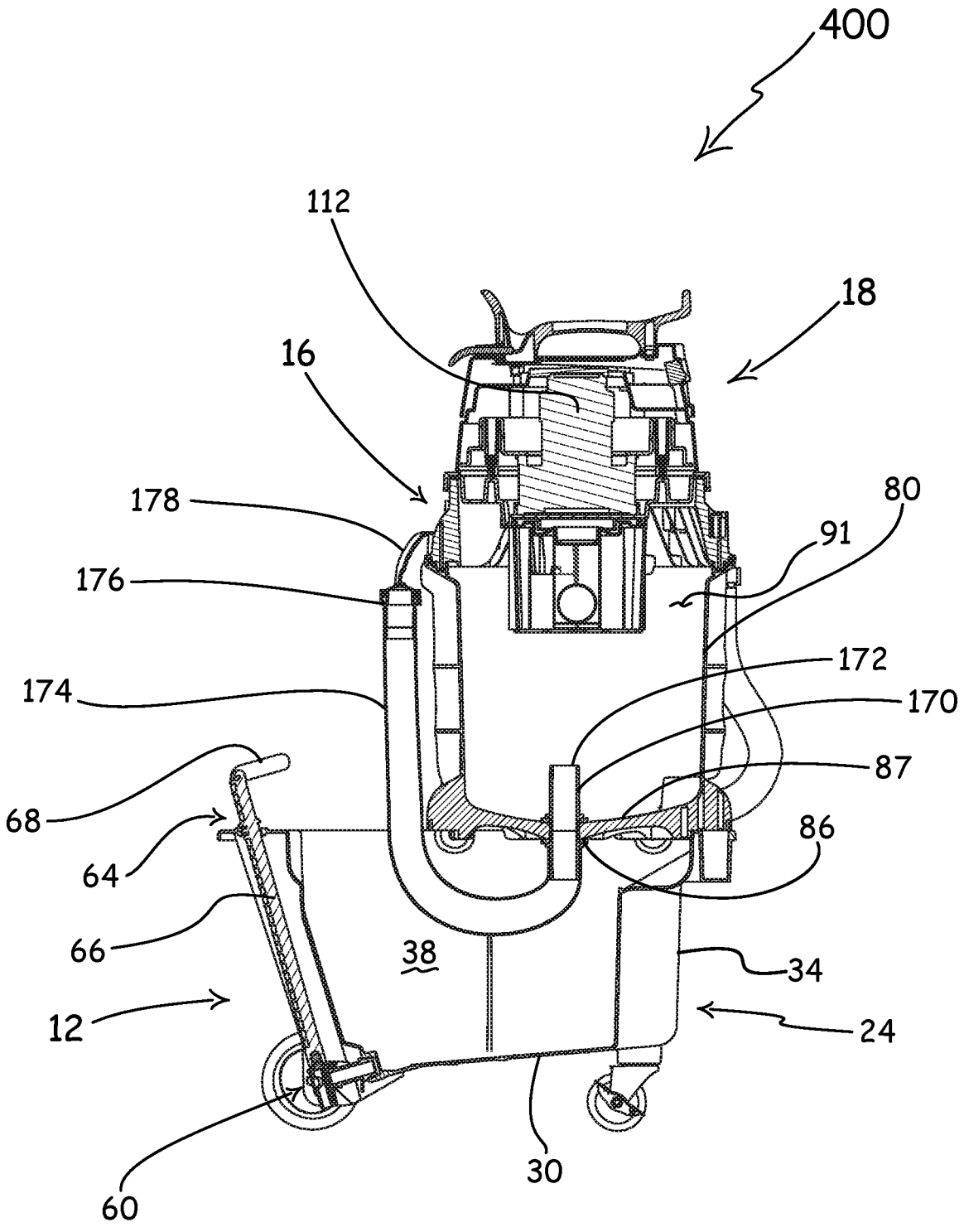
FIG. 9 is a cross-sectional view of a further embodiment of the portable liquid-recycling liquid-reusing cleaning system for hard surface flooring, in accordance with the principles of the invention.

With reference to FIG. 9, the portable floor care system embodiment 400 is identical to the embodiment 10 with the following exceptions. The embodiment 400 does not have the standpipe 144, the gazebo nut 148, or the gate valve assembly 146. Instead, the embodiment 400 has a transfer-hose-and-cap assembly. A cleaning liquid transfer outlet includes a generally vertically oriented tube that extends through a centrally located opening in the bottom wall 86 of the vacuum recovery tank 80. An upper portion of the tube is a standpipe 170 that extends upward from the bottom wall 86; and a lower portion of the tube extends downward from the bottom wall 86. The cleaning liquid transfer outlet has a cleaning liquid entry opening 172 that includes an inlet end of the tube. An inlet end of a cleaning liquid transfer hose 174 is connected to an outlet end of the generally vertically oriented tube, a cap 176 is connected to an outlet end of the cleaning liquid transfer hose 174, and a strap 178 connects the cap 176 to an upper exterior surface of the vacuum recovery tank 80. A mushroom filter 168 is attached to the inlet end of the tube 160. As seen in FIG. 9, the transfer hose 174 is in an upwardly-extending stowed position. When a user wants to transfer cleaning liquid from the tank 80 to the bucket 24, the user may remove the cap 176 from the hose 174 and orient the outlet end of the hose downward into the bucket 24. When a user wants to stop the transfer of cleaning liquid from the tank 80 to the bucket 24, the user may raise the transfer hose 174 upward and close the outlet end of the hose 174 with the cap 176.

Figure 10:
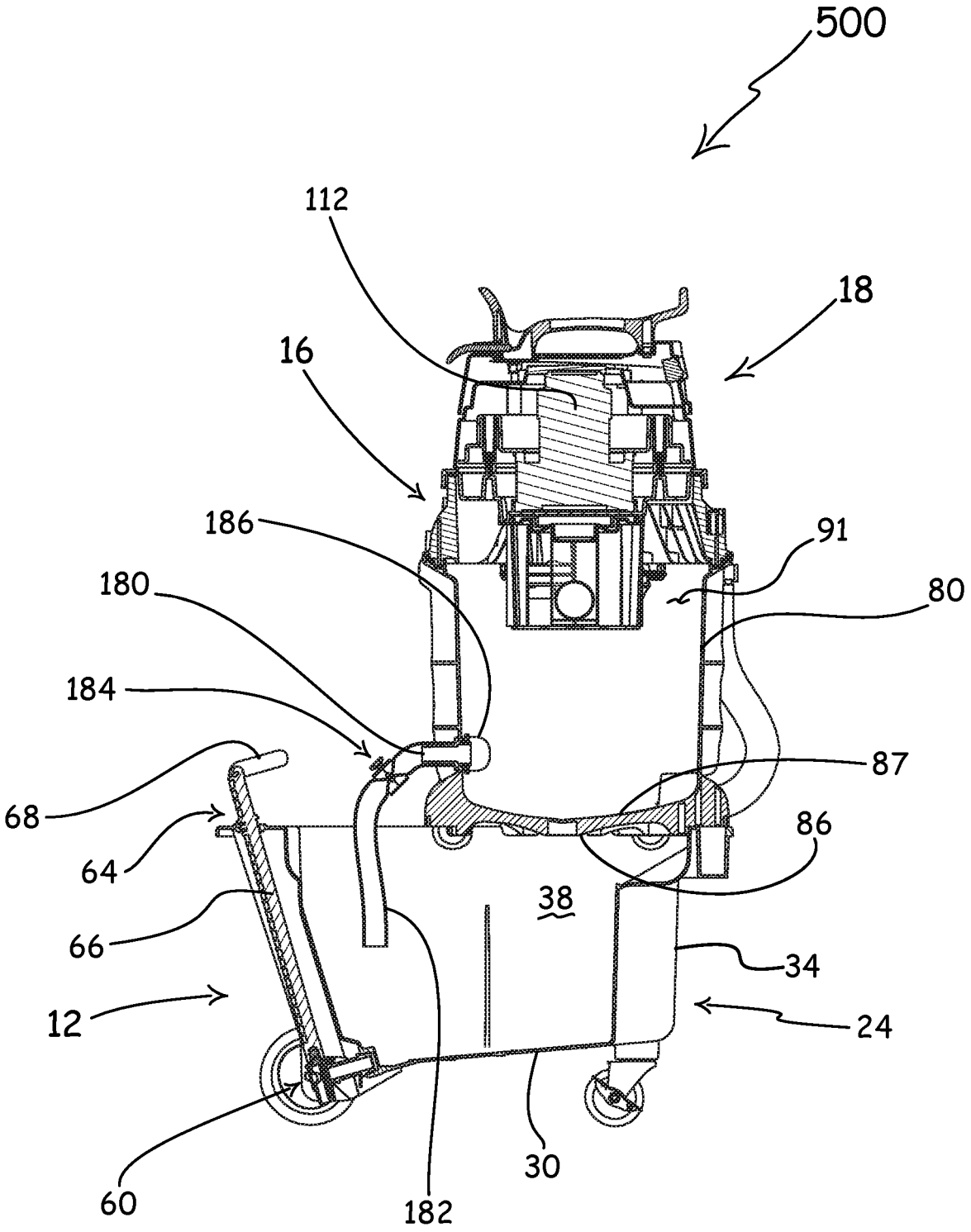
FIG. 10 is a cross-sectional view of yet another embodiment of the portable liquid-recycling liquid-reusing cleaning system for hard surface flooring, in accordance with the principles of the invention.

With reference to FIG. 10, the portable floor care system embodiment 500 is identical to the embodiment 10 with the following exceptions. The embodiment 500 does not have the standpipe 144, the gazebo nut 148, or the gate valve assembly 146. Instead, the embodiment 500 has a transfer-hose-and-pinch-valve assembly. A cleaning liquid transfer outlet includes a generally horizontally extending tube 180 that extends from the interior of the vacuum recovery tank 80 rearward through the back wall 90 of the tank 80. The cleaning liquid transfer outlet has a cleaning liquid entry opening that includes an inlet end of the tube 180. An inlet end of a cleaning liquid transfer hose 182 is connected to an outlet end of the tube 180, and a pinch valve 184 is located at a position along the length of the hose 182. A mushroom filter 186 is attached to the inlet end of the tube 180. As seen in FIG. 10, the pinch valve 184 is closed, and an outlet end of the transfer hose 182 extends downward into the bucket 24. When a user wants to transfer cleaning liquid from the tank 80 to the bucket 24, the user may open the pinch valve 184. When a user wants to stop the transfer of cleaning liquid from the tank 80 to the bucket 24, the user may close the pinch valve 184.

Figure 11:
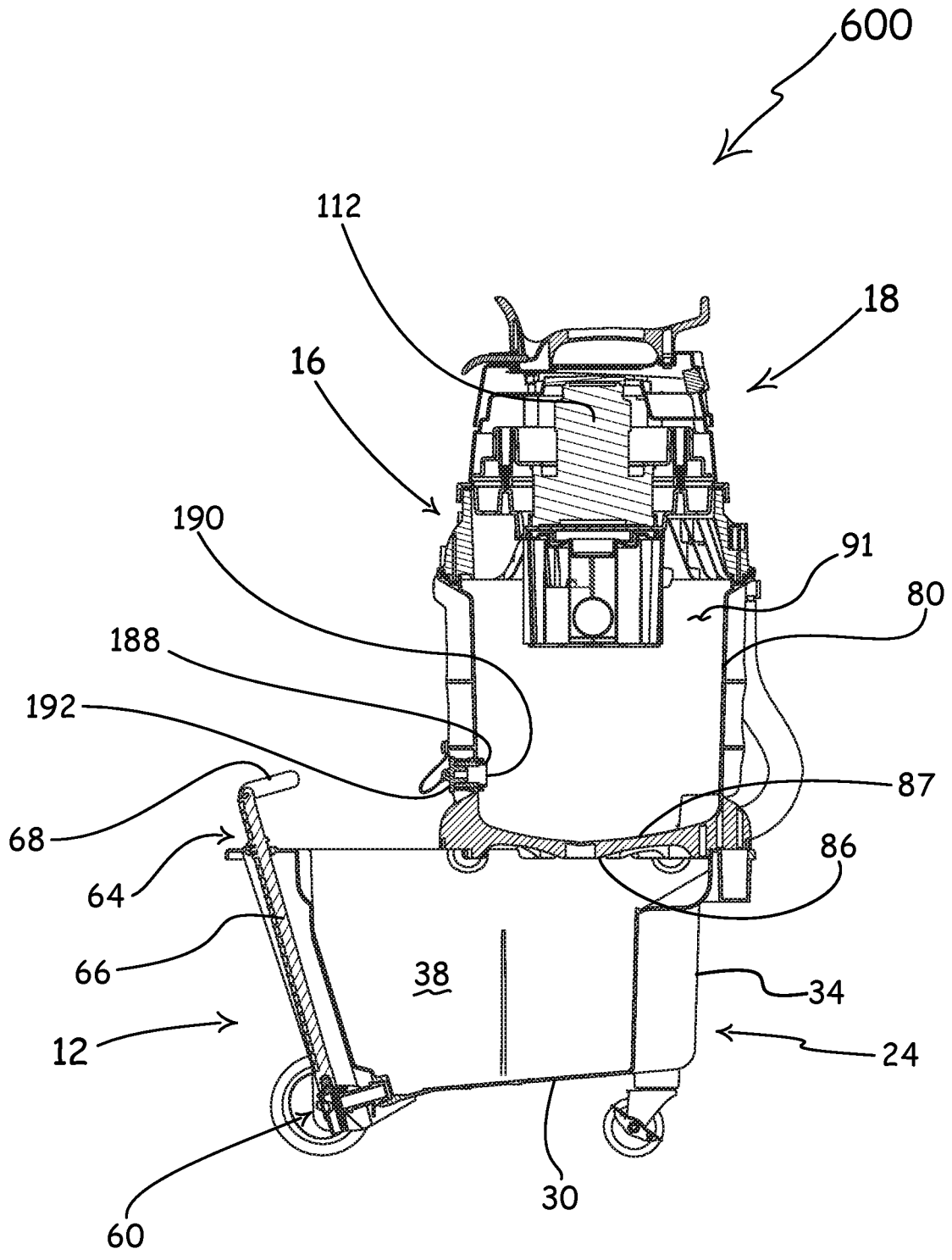
FIG. 11 is a cross-sectional view of yet an additional embodiment of the portable liquid-recycling liquid-reusing cleaning system for hard surface flooring, in accordance with the principles of the invention.

With reference to FIG. 11, the portable floor care system embodiment 600 is identical to the embodiment 10 with the following exceptions. The embodiment 600 does not have the standpipe 144, the gazebo nut 148, or the gate valve assembly 146. Instead, the embodiment 600 has a plug 192. A cleaning liquid transfer outlet includes a generally horizontally extending tube 188 that extends from the interior of the vacuum recovery tank 80 rearward through the back wall 90 of the tank 80. The cleaning liquid transfer outlet has a cleaning liquid entry opening 190 that includes an inlet end of the tube 188. As seen in FIG. 11, the tube 188 has an outlet end; and the plug 192 is removably positioned in the tube 188 at the outlet end, thereby closing or sealing off the tube 188. When a user wants to transfer cleaning liquid from the tank 80 to the bucket 24, the user may remove the plug 192 from the outlet end of the tube 188. When a user wants to stop the transfer of cleaning liquid from the tank 80 to the bucket 24, the user may reinsert the plug 192 at the outlet end of the tube 188.

Figure 12:
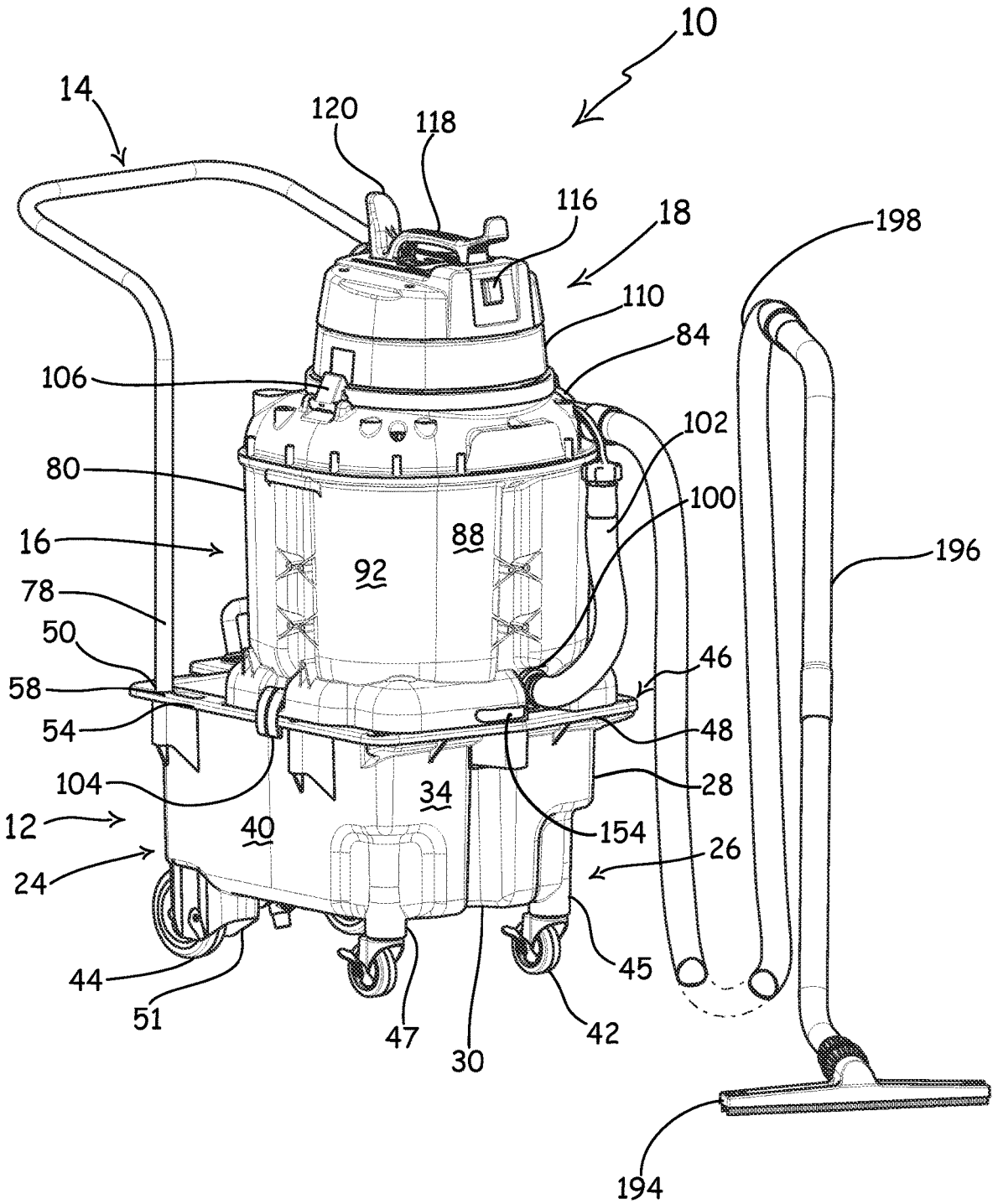
FIG. 12 is a perspective view of the portable liquid-recycling liquid-reusing cleaning system of FIG. 1, with the cleaning system further including a floor tool, a vacuum wand, and a vacuum hose.

With reference to FIG. 12, the portable floor care system embodiment 10 is shown in combination with a squeegee floor tool 194, a vacuum wand 196 and a vacuum hose 198.

Figure 13:
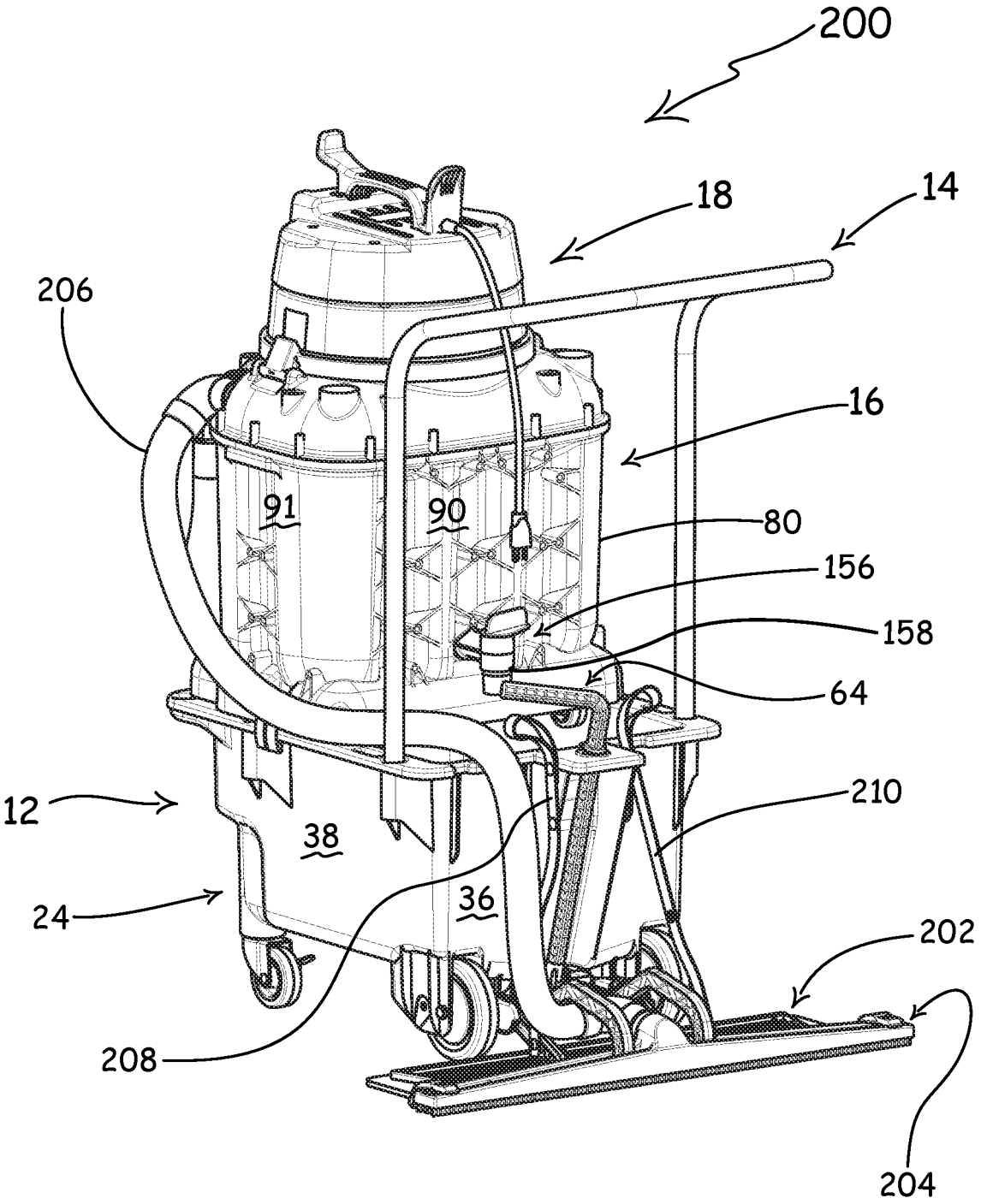
FIG. 13 is a perspective view of the portable liquid-recycling liquid-reusing cleaning system of FIGS. 5-7, with the cleaning system further including a liquid spreader assembly, a squeegee head assembly, and a vacuum hose.
Figure 14:
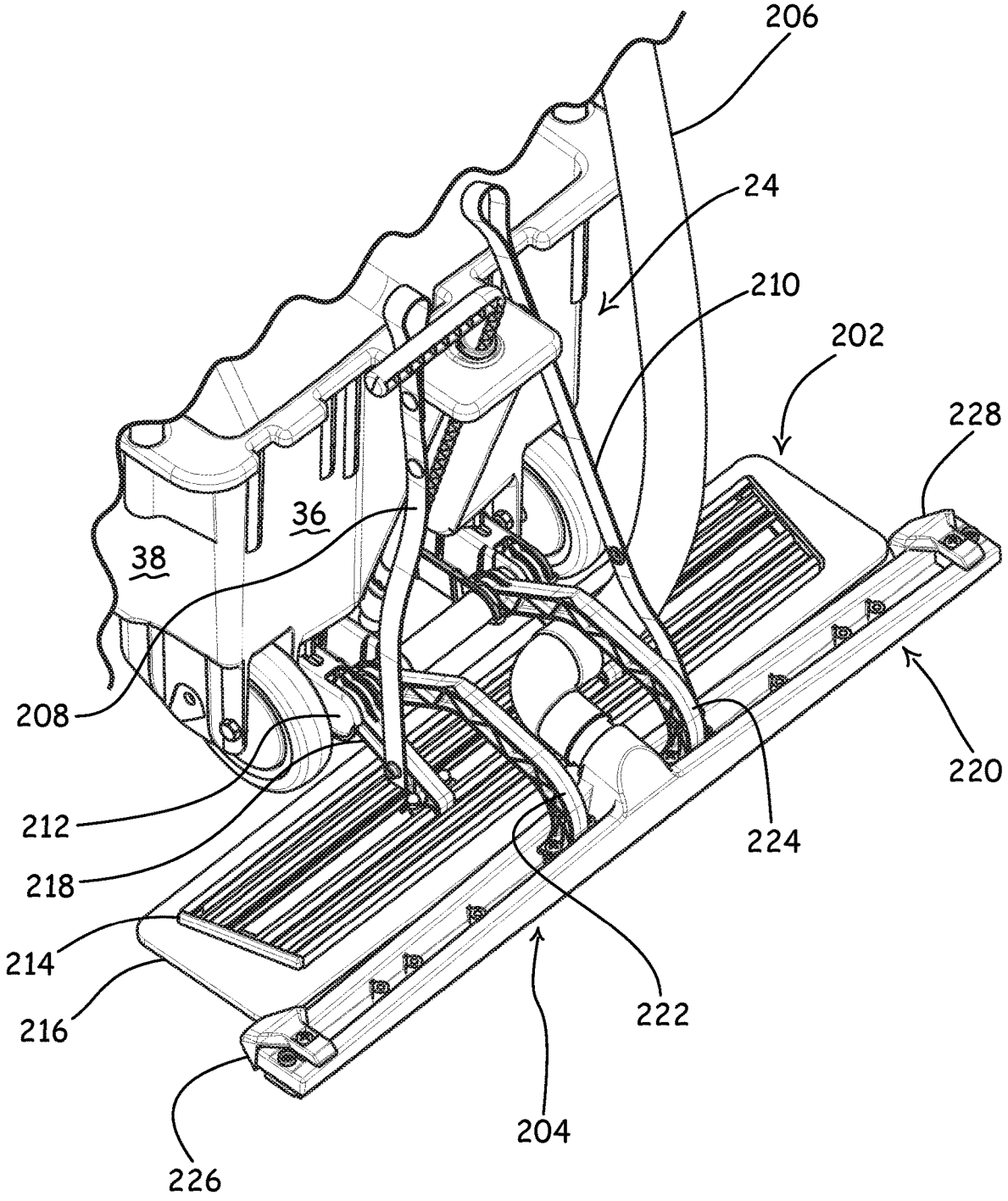
FIG. 14 is a perspective view of a portion of a portable liquid-recycling liquid-reusing cleaning system substantially similar to the portable liquid-recycling liquid-rousing cleaning system of FIG. 13.

With reference to FIGS. 13 and 14, the portable floor care system embodiment 200 is shown in combination with a liquid spreader assembly 202, a squeegee head assembly 204, a vacuum hose 206, a liquid spreader assembly strap 208, and a squeegee head assembly strap 210. The embodiment 200 also has a hitch assembly 212. The liquid spreader assembly 202 has a frame 214, a spreader pad 216, and a pair of connecting arms (as at 218). The squeegee head assembly 204 has a frame assembly 220, a pair of connecting arms 222, 224, and a pair of plow members 226, 228. The liquid spreader assembly 202 includes, among other things, a floor-contacting microfiber soft cloth spreader pad. The spreading of dispensed cleaning liquid on hard surface flooring with the liquid spreader assembly includes spreading the dispensed cleaning liquid with the microfiber soft cloth spreader pad. If desired, the microfiber soft cloth spreader pad may be washable and reusable. The components shown in FIGS. 13 and 14 and listed above are shown and described in great detail in: (1) U.S. Pat. No. 10,786,131, entitled "Multi-Functional Cleaning and Floor Care System" and issued on Sep. 29, 2020; and (2) U.S. Patent Application Publication No. US 2013/0139346, entitled "Multi-Functional Cleaning and Floor Care System" and published on Jun. 6, 2013. The entire disclosure of each of (1) U.S. Pat. No. 10,786,131 and (2) U.S. Patent Application Publication No. US 2013/0139346 is incorporated into this patent document by reference.

Figure 15:
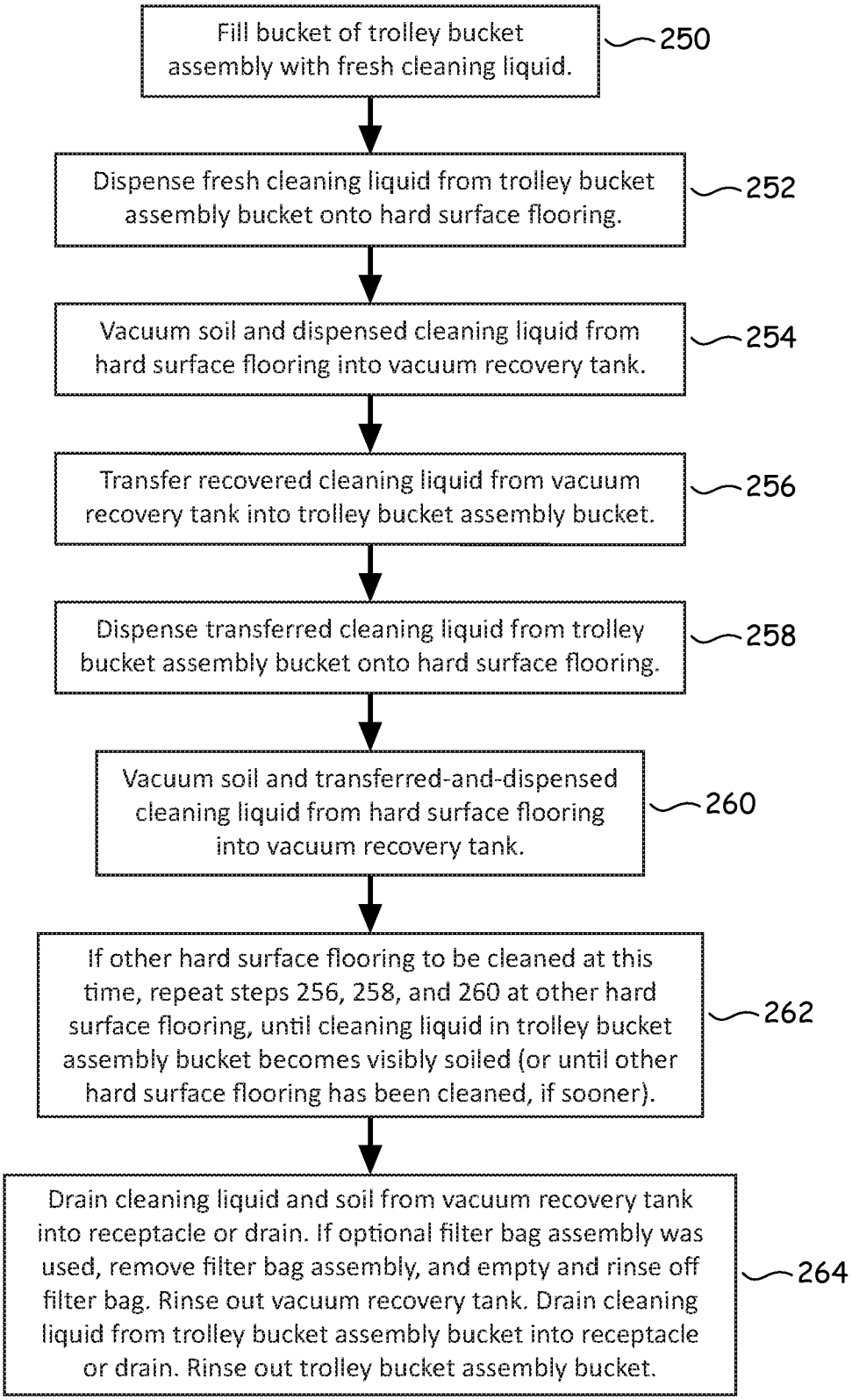
FIG. 15 is a flow chart of an embodiment of a method of cleaning hard surface flooring, using any of the portable liquid-recycling liquid-reusing cleaning systems shown in FIGS. 1-14.

With reference to FIG. 15, an embodiment of the method of cleaning hard surface flooring with a portable liquid-recycling liquid-reusing cleaning system is shown.

Figure 16:
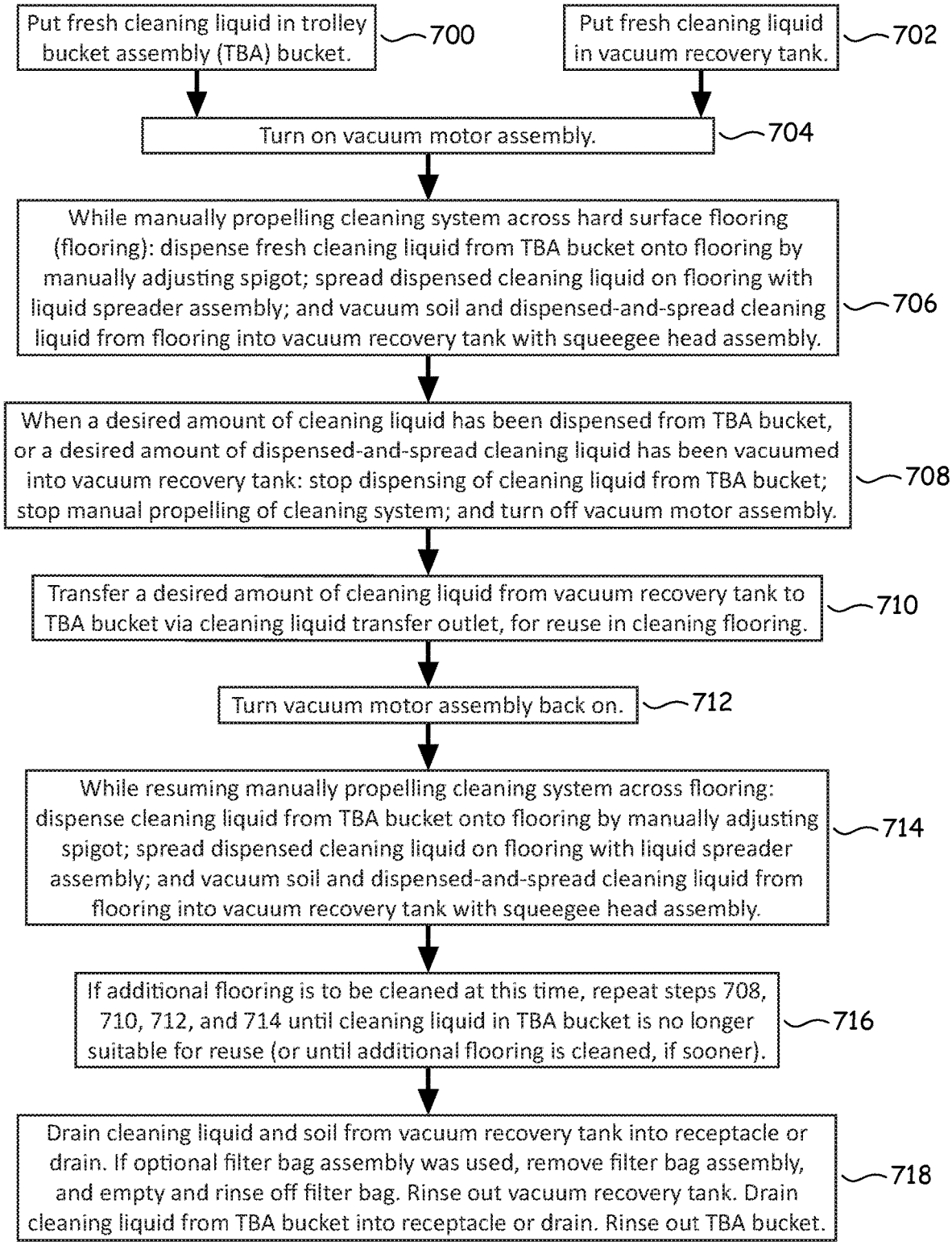
FIG. 16 is a flow chart of an embodiment of the method of cleaning hard surface flooring, in accordance with the principles of the invention, using the portable liquid-recycling liquid-reusing cleaning system of FIGS. 13 and 14.

With reference to FIG. 16, another embodiment of the method of cleaning hard surface flooring with a portable liquid-recycling liquid-reusing cleaning system is shown. This method embodiment is performed using the cleaning system shown in FIGS. 13 and 14 and described above.

In this embodiment, a user begins by putting fresh cleaning liquid not only in the trolley bucket assembly bucket ("bucket") (700), but also in the vacuum recovery tank (702). The user then manually propels the cleaning system to the hard surface flooring ("flooring") to be cleaned. Also the user turns on the vacuum motor assembly (704).

While manually propelling the cleaning system across the flooring (706), the user manually adjusts the spigot so that fresh cleaning liquid is dispensed from the bucket through the outlet end of the spigot onto the flooring at a desired flow rate. A moment after the fresh cleaning liquid contacts the flooring, a floor-contacting microfiber pad of the liquid spreader assembly spreads the cleaning liquid and forms a thin layer of cleaning liquid on the flooring. Soil that is present on the flooring mixes with this thin layer of cleaning liquid. A moment after that, the mixture is vacuumed up through the floor-contacting squeegee head assembly, through a length of vacuum hose, and into the vacuum recovery tank ("tank"). At this point, the cleaning liquid in the tank is a lightly-soiled cleaning liquid, with the recovered (i.e., vacuumed-up) soil-containing cleaning liquid having mixed with the fresh cleaning liquid originally put into the tank. The lightly-soiled cleaning liquid in the tank has the capacity to "hold" additional soil, and therefore can be used to clean additional flooring.

When a desired amount of cleaning liquid has been dispensed from the bucket, or a desired amount of dispensed-and-spread soil-containing cleaning liquid has been vacuumed into the tank, the user temporarily: stops dispensing cleaning liquid from the bucket; stops manually propelling the cleaning system; and turns off the vacuum motor assembly (708). If the amount of cleaning liquid in the tank is great enough, it will activate the float shut-off system, thereby stopping the vacuum motor; however, it is still preferred to turn the vacuum motor assembly off (e.g., via an on-off switch).

At this point, the user transfers a desired amount of the lightly-soiled cleaning liquid from the tank to the bucket via the tank cleaning liquid transfer outlet and the manually-adjustable tank spigot 158 (i.e., the vacuum recovery tank spigot assembly 156), for reuse in cleaning additional flooring (710). (The tank spigot assembly 156 and tank spigot 158 are discussed above in connection with FIGS. 5-7.) If some cleaning liquid remains in the bucket prior to the transfer, then the lightly-soiled cleaning liquid from the tank mixes with the remaining cleaning liquid in the bucket upon transfer.

Now the user turns the vacuum motor assembly back on (712) and resumes manually propelling the cleaning system across the flooring (714). While manually propelling the cleaning system across the flooring, the user manually adjusts the spigot so that lightly-soiled cleaning liquid is dispensed from the bucket through the outlet end of the spigot onto the flooring at the desired flow rate. A moment after the lightly-soiled cleaning liquid contacts the flooring, the floor-contacting microfiber pad of the liquid spreader assembly spreads the cleaning liquid and forms a thin layer of cleaning liquid on the flooring. Soil that is present on the flooring mixes with this thin layer of cleaning liquid, forming a moderately-soiled cleaning liquid. A moment after that, the mixture is vacuumed up through the floor-contacting squeegee head assembly, through a length of vacuum hose, and into the vacuum recovery tank ("tank"). At this point, the cleaning liquid in the tank is a moderately-soiled cleaning liquid, with the newly recovered moderately-soiled cleaning liquid having mixed with the lightly-soiled cleaning liquid already in the tank. The moderately-soiled cleaning liquid in the tank still has the capacity to hold additional soil, and therefore can be used to clean additional flooring.

If additional flooring is to be cleaned at this time, the user repeats steps 708, 710, 712, and 714 until the cleaning liquid in the bucket is no longer suitable for reuse (e.g., is heavily soiled or is visibly soiled) or until the additional flooring is cleaned if sooner (716).

The user then drains the cleaning liquid and soil from the tank into a suitable receptacle or drain and rinses out the tank. If a filter bag assembly was used, the filter bag assembly is removed, emptied, and rinsed off. The user also drains any remaining cleaning liquid and soil from the bucket into a suitable receptacle or drain and rinses out the bucket (718).

Figure 17:
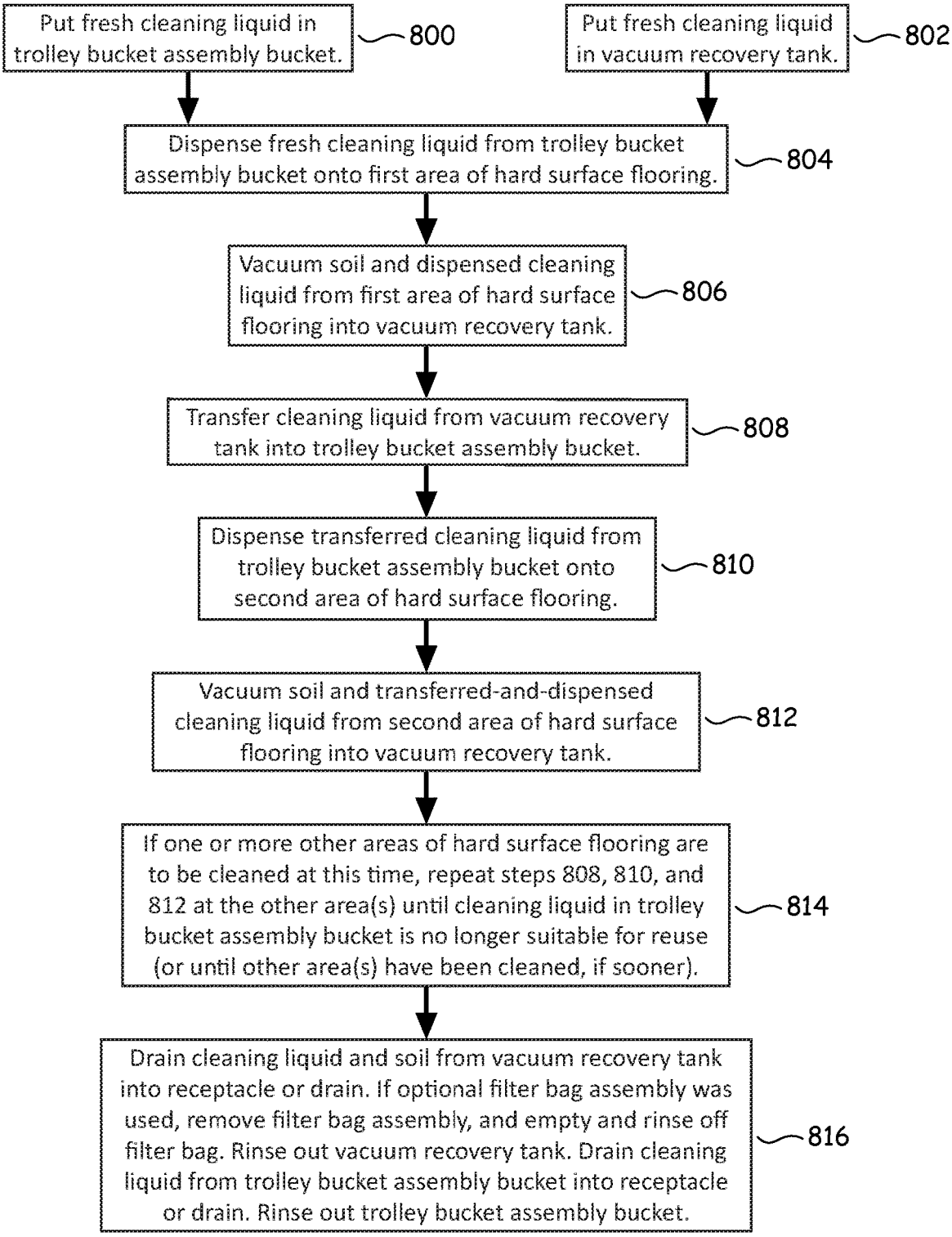
FIG. 17 is a flow chart of another embodiment of the method of cleaning hard surface flooring, in accordance with the principles of the invention, using any of the portable liquid-recycling liquid-reusing cleaning systems shown FIGS. 1-14.

With reference to FIG. 17, a further embodiment of the method of cleaning hard surface flooring with a portable liquid-recycling liquid-reusing cleaning system is shown. This method embodiment may be performed using any suitable cleaning system embodiment of the invention, with nonlimiting examples including the cleaning system embodiments shown in FIGS. 1-14 and described above.

In this embodiment, a user begins by putting fresh cleaning liquid not only in the trolley bucket assembly bucket ("bucket") (800), but also in the vacuum recovery tank (802).

The user then dispenses a desired amount of fresh cleaning liquid from the bucket onto a first area of hard surface flooring ("flooring") via the spigot by manually adjusting the spigot (804). Soil that is present on the first area of flooring mixes with the dispensed fresh cleaning liquid to form a soil-containing cleaning liquid.

The user vacuums soil and dispensed cleaning liquid from the first area of flooring into the vacuum recovery tank ("tank") (806). At this point, the cleaning liquid in the tank is a lightly-soiled cleaning liquid, with the recovered (i.e., vacuumed-up) soil-containing cleaning liquid having mixed with the fresh cleaning liquid originally put into the tank. The lightly-soiled cleaning liquid in the tank has the capacity to "hold" additional soil, and therefore can be used to clean additional flooring.

Next the user transfers a desired amount of the lightly-soiled cleaning liquid from the tank to the bucket via the cleaning liquid transfer outlet), for reuse in cleaning additional flooring (808). If some cleaning liquid remains in the bucket prior to the transfer, then the lightly-soiled cleaning liquid from the tank mixes with the remaining cleaning liquid in the bucket upon transfer.

The user then dispenses a desired amount of the lightly-soiled cleaning liquid from the bucket onto a second area of flooring via the spigot by manually adjusting the spigot (810). Soil that is present on the second area of flooring mixes with the dispensed lightly-soiled cleaning liquid, forming a moderately-soiled cleaning liquid.

The user vacuums moderately-soiled cleaning liquid (i.e., soil and transferred-and-dispensed cleaning liquid) from the second area of flooring into the tank (812). At this point, the cleaning liquid in the tank is a moderately-soiled cleaning liquid, with the newly recovered moderately-soiled cleaning liquid having mixed with the lightly-soiled cleaning liquid already in the tank. The moderately-soiled cleaning liquid in the tank still has the capacity to hold additional soil, and therefore can be used to clean additional flooring.

If one or more other areas of flooring are to be cleaned at this time, the user repeats steps 808, 810, and 812 at the other area(s) until the cleaning liquid in the bucket is no longer suitable for reuse (e.g., is heavily soiled or is visibly soiled) or until the other area(s) have been cleaned if sooner (814).

The user then drains the cleaning liquid and soil from the tank into a suitable receptacle or drain and rinses out the tank. If a filter bag assembly was used, the filter bag assembly is removed, emptied, and rinsed off. The user also drains any remaining cleaning liquid and soil from the bucket into a suitable receptacle or drain and rinses out the bucket (816).

Typically, a portable liquid-recycling liquid-reusing cleaning system of the present invention does not include a pump to assist in transferring cleaning liquid from the vacuum recovery tank through the cleaning liquid transfer outlet to the bucket. Instead, such a portable cleaning system uses the natural force of gravity to facilitate this transfer. With reference to the Figures, the portable liquid-recycling liquid-reusing cleaning system embodiments shown are free of such a pump.

Also, typically a portable liquid-recycling liquid-reusing cleaning system of the present invention does not include a pump to assist in dispensing cleaning liquid from the bucket through the spigot—either directly or indirectly onto an area of hard surface flooring. Instead, such a portable cleaning system uses the natural force of gravity to facilitate dispensing cleaning liquid from the bucket through the spigot. With reference to the Figures, the portable liquid-recycling liquid-reusing cleaning system embodiments shown are free of such a pump.

A portable liquid-recycling liquid-reusing cleaning system of the present invention may be made using any suitable material(s) and manufacturing technique(s). For example, if desired, the bucket may be made of polypropylene using injection molding, and the vacuum recovery tank may be made of polyethylene via rotational molding.

Additional aspects of the portable liquid-recycling liquid-reusing cleaning system method for cleaning hard surface flooring are shown and described in: (1) Provisional Application No. 62/130,610, entitled "Liquid-Recycling Multi-Functional Cleaning and Floor Care System" and filed on Mar. 10, 2015; and (2) U.S. Pat. No. 10/959,592, entitled "Portable Liquid-Recycling Liquid-Reusing Cleaning System for Hard Surface Flooring" and issued on Mar. 30, 2021. The entire disclosure of each of (1) Provisional Application No. 62/130,610 and (2) U.S. Pat. No. 10,959,592 is incorporated into this patent document by reference.

The method of cleaning hard surface flooring provides several benefits and advantages. For example, because the method includes putting fresh cleaning liquid in both the bucket and the vacuum recovery tank, the method makes it possible to dean a far greater amount of hard surface flooring before the recovered and reused cleaning liquid becomes unsuitable for further reuse, and therefore, before a user must suspend the cleaning process, return the cleaning system to a typically remote dumping-and-filling station, drain cleaning liquid and soil from the bucket and the vacuum recovery tank, rinse out the bucket and the vacuum recovery tank with clean water, re-fill the bucket and the vacuum recovery tank with fresh cleaning liquid, return the cleaning system to the hard surface flooring, and continue the cleaning process. And because the method greatly increases the amount of flooring that can be cleaned between dumping and refilling, the method greatly increases the productivity of the cleaning system and of a user operating the cleaning system (e.g., the number of square feet of flooring cleaned per hour).

Also, because the method includes putting fresh cleaning liquid in both the bucket and the vacuum recovery tank, the head pressure on the cleaning liquid in each of the trolley bucket and the vacuum recovery tank is increased. The increased head pressure facilitates a faster transfer of cleaning liquid from the vacuum recovery tank to the bucket, and a faster dispensing of cleaning liquid from the bucket to the hard surface flooring. Accordingly, the method further increases the productivity of the cleaning system and of a user operating the cleaning system (e.g., the number of square feet of flooring cleaned per hour).

While the present invention has been illustrated by a description of embodiments, and while the illustrative embodiments have been described in considerable detail, it is not the intention of the inventors to restrict or in any way limit the scope of the following claims to such detail. Additional advantages and modifications readily will appear to those skilled in the art upon a reading of this patent document. The invention, in its broader aspects, is therefore not limited to the specific details, representative apparatus and methods, and illustrative examples shown and described in this patent document. Accordingly, departures may be made from such details without departing from the spirit or scope of the inventors' general inventive concept.

What is claimed is:

1. A method of cleaning hard surface flooring with a portable liquid-recycling liquid-reusing cleaning system, comprising:

providing a portable liquid-recycling liquid-reusing cleaning system, comprising:

a trolley bucket assembly including:

a bucket operable to hold cleaning liquid;

a wheeled chassis; and a manually-adjustable spigot fluidly connected to the bucket, the spigot including a valve that is adjustable throughout a range from a fully open position to a fully closed position, whereby when the bucket contains cleaning liquid, a user may dispense and regulate the flow of cleaning liquid from the bucket through the spigot by manually adjusting the spigot;

a vacuum recovery tank positioned on the trolley bucket assembly, the vacuum recovery tank operable to hold cleaning liquid and soil, the vacuum recovery tank including a bottom wall, a vacuum recovery inlet, and a cleaning liquid transfer outlet through which cleaning liquid from the vacuum recovery tank may be transferred to the bucket for reuse, with the vacuum recovery tank bottom wall including an interior surface, and with the cleaning liquid transfer outlet including a cleaning liquid entry opening through which cleaning liquid from the vacuum recovery tank enters the cleaning liquid transfer outlet, with the cleaning liquid entry opening positioned above at least a portion of the vacuum recovery tank bottom wall interior surface, thereby inhibiting soil that settles on the portion of the vacuum recovery tank bottom wall interior surface from passing through the vacuum recovery tank cleaning liquid transfer outlet;

a vacuum motor assembly fluidly connected to the vacuum recovery tank;

a liquid spreader assembly operable to spread on hard surface flooring cleaning liquid that is dispensed from the bucket through the spigot; and a squeegee head assembly fluidly connected to the vacuum recovery inlet, the squeegee head assembly operable to vacuum soil and dispensed cleaning liquid from hard surface flooring into the vacuum recovery tank;

putting fresh cleaning liquid in the bucket;

putting fresh cleaning liquid in the vacuum recovery tank;

while manually propelling the cleaning system across hard surface flooring: dispensing fresh cleaning liquid from the bucket onto hard surface flooring by manually adjusting the spigot; spreading dispensed fresh cleaning liquid on hard surface flooring with the liquid spreader assembly; and vacuuming soil and dispensed-and-spread cleaning liquid from hard surface flooring into the vacuum recovery tank with the squeegee head assembly;

when a desired amount of cleaning liquid has been dispensed from the bucket, or a desired amount of dispensed-and-spread cleaning liquid has been vacuumed into the vacuum recovery tank: stopping the dispensing of cleaning liquid from the bucket; and stopping the manual propelling of the cleaning system;

transferring a desired amount of cleaning liquid from the vacuum recovery tank to the bucket via the cleaning liquid transfer outlet; and resuming manually propelling the cleaning system across hard surface flooring while also: dispensing cleaning liquid from the bucket onto hard surface flooring by manually adjusting the spigot; spreading dispensed cleaning liquid on hard surface flooring with the liquid spreader assembly; and vacuuming soil and dispensed-and-spread cleaning liquid from hard surface flooring into the vacuum recovery tank with the squeegee head assembly.

2. The method of claim 1 further comprising:

when a subsequent desired amount of cleaning liquid has been dispensed from the bucket, or a subsequent desired amount of dispensed-and-spread cleaning liquid has been vacuumed into the vacuum recovery tank: stopping the dispensing of cleaning liquid from the bucket; and stopping the manual propelling of the cleaning system;

transferring a desired amount of cleaning liquid from the vacuum recovery tank to the bucket via the cleaning liquid transfer outlet; and resuming manually propelling the cleaning system across hard surface flooring while also: dispensing cleaning liquid from the bucket onto hard surface flooring by manually adjusting the spigot; spreading dispensed cleaning liquid on hard surface flooring with the liquid spreader assembly; and vacuuming soil and dispensed-and-spread cleaning liquid from hard surface flooring into the vacuum recovery tank with the squeegee head assembly.

3. The method of claim 2 further comprising repeating the steps of claim 2 until the cleaning liquid in the bucket is no longer suitable for reuse, or until a desired amount of additional hard surface flooring has been cleaned if sooner.

4. The method of claim 1 wherein the portable liquid-recycling liquid-reusing cleaning system further comprises means for facilitating regulating the flow of cleaning liquid from the vacuum recovery tank to the bucket, and the method further comprises using or operating the means for regulating the flow to facilitate transferring the desired amount of cleaning liquid from the vacuum recovery tank to the bucket via the cleaning liquid transfer outlet.

5. The method of claim 4 wherein the means for facilitating regulating the flow of cleaning liquid from the vacuum recovery tank to the bucket includes one or more of a spigot, a gate valve, a valve, a tube, a flexible hose, a cap, and a plug.

6. The method of claim 5 wherein the means for facilitating regulating the flow of cleaning liquid from the vacuum recovery tank to the bucket includes a manually-adjustable spigot fluidly connected to the cleaning liquid transfer outlet of the vacuum recovery tank.

7. The method of claim 6 wherein the manually-adjustable spigot includes a valve that is adjustable throughout a range from a fully open position to a fully closed position.

8. The method of claim 1 wherein the liquid spreader assembly includes a floor-contacting microfiber soft cloth spreader pad, and wherein the spreading of dispensed cleaning liquid on hard surface flooring with the liquid spreader assembly includes spreading the dispensed cleaning liquid with the microfiber soft cloth spreader pad.

9. A method of cleaning hard surface flooring with a portable liquid-recycling liquid-reusing cleaning system, comprising:

providing a portable liquid-recycling liquid-reusing cleaning system, comprising:

a trolley bucket assembly including:

a bucket operable to hold cleaning liquid;

a wheeled chassis; and a manually-adjustable spigot fluidly connected to the bucket, the spigot including a valve that is adjustable throughout a range from a fully open position to a fully closed position, whereby when the bucket contains cleaning liquid, a user may dispense and regulate the flow of cleaning liquid from the bucket through the spigot by manually adjusting the spigot;

a vacuum recovery tank positioned on the trolley bucket assembly, the vacuum recovery tank operable to hold cleaning liquid and soil, the vacuum recovery tank including a bottom wall, a vacuum recovery inlet, and a cleaning liquid transfer outlet through which cleaning liquid from the vacuum recovery tank may be transferred to the bucket for reuse, with the vacuum recovery tank bottom wall including an interior surface, and with the cleaning liquid transfer outlet including a cleaning liquid entry opening through which cleaning liquid from the vacuum recovery tank enters the cleaning liquid transfer outlet, with the cleaning liquid entry opening positioned above at least a portion of the vacuum recovery tank bottom wall interior surface, thereby inhibiting soil that settles on the portion of the vacuum recovery tank bottom wall interior surface from passing through the vacuum recovery tank cleaning liquid transfer outlet; and a vacuum motor assembly fluidly connected to the vacuum recovery tank;

putting fresh cleaning liquid in the bucket;

putting fresh cleaning liquid in the vacuum recovery tank;

dispensing fresh cleaning liquid from the bucket onto a first area of hard surface flooring via the spigot by manually adjusting the spigot;

vacuuming soil and dispensed cleaning liquid from the first area of hard surface flooring into the vacuum recovery tank;

transferring a desired amount of cleaning liquid from the vacuum recovery tank to the bucket via the cleaning liquid transfer outlet;

dispensing cleaning liquid from the bucket onto a second area of hard surface flooring via the spigot by manually adjusting the spigot; and vacuuming soil and dispensed cleaning liquid from the second area of hard surface flooring into the vacuum recovery tank.

10. The method of claim 9 further comprising:

transferring a desired amount of cleaning liquid from the vacuum recovery tank to the bucket via the cleaning liquid transfer outlet;

dispensing cleaning liquid from the bucket onto an additional area of hard surface flooring via the spigot by manually adjusting the spigot; and vacuuming soil and dispensed cleaning liquid from the additional area of hard surface flooring into the vacuum recovery tank.

11. The method of claim 10 further comprising repeating the steps of claim 10 at one or more other additional areas of hard surface flooring until the cleaning liquid in the bucket is no longer suitable for reuse, or until a desired amount of additional hard surface flooring has been cleaned if sooner.

12. The method of claim 9 wherein the portable liquid-recycling liquid-reusing cleaning system further comprises means for facilitating regulating the flow of cleaning liquid from the vacuum recovery tank to the bucket, and the method further comprises using or operating the means for regulating the flow to facilitate transferring the desired amount of cleaning liquid from the vacuum recovery tank to the bucket via the cleaning liquid transfer outlet.

13. The method of claim 12 wherein the means for facilitating regulating the flow of cleaning liquid from the vacuum recovery tank to the bucket includes one or more of a spigot, a gate valve, a valve, a tube, a flexible hose, a cap, and a plug.

14. The method of claim 13 wherein the means for facilitating regulating the flow of cleaning liquid from the vacuum recovery tank to the bucket includes a manually-adjustable spigot fluidly connected to the cleaning liquid transfer outlet of the vacuum recovery tank.

15. The method of claim 14 wherein the manually-adjustable spigot includes a valve that is adjustable throughout a range from a fully open position to a fully closed position.

* * * * *